US006502931B2

(12) United States Patent
Udagawa et al.

(10) Patent No.: US 6,502,931 B2
(45) Date of Patent: Jan. 7, 2003

(54) LIQUID CONTAINER

(75) Inventors: Kenta Udagawa, Kawasaki (JP); Shozo Hattori, Tokyo (JP); Hajime Yamamoto, Yokohama (JP); Eiichiro Shimizu, Yokohama (JP); Jun Hinami, Yokohama (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 09/304,980

(22) Filed: May 4, 1999

(65) Prior Publication Data

US 2002/0167570 A1 Nov. 14, 2002

(30) Foreign Application Priority Data

May 11, 1998 (JP) ..... 10-127376
Apr. 27, 1999 (JP) ..... 11-119634

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 5,182,581 A | | 1/1993 | Kashimura et al. | |
| 5,742,312 A | * | 4/1998 | Carlotta | 347/87 |
| 5,790,157 A | * | 8/1998 | Higuma et al. | 347/85 |
| 5,900,898 A | | 5/1999 | Shimizu et al. | 347/93 |
| 6,113,230 A | | 9/2000 | Ishinaga et al. | 347/86 |
| 6,137,512 A | * | 10/2000 | Higuma et al. | 347/86 |
| 6,145,972 A | * | 11/2000 | Udagawa et al. | 347/86 |
| 6,164,769 A | | 12/2000 | Inada et al. | 347/86 |
| 6,168,266 B1 | | 1/2001 | Ishinaga et al. | 347/86 |
| 6,206,513 B1 | | 3/2001 | Tajima et al. | 347/86 |
| 6,206,514 B1 | | 3/2001 | Tajima et al. | 347/86 |

FOREIGN PATENT DOCUMENTS

| | | | |
|---|---|---|---|
| EP | 0 488 829 | | 6/1992 |
| EP | 0 730 966 | | 9/1996 |
| EP | 0 791 466 | | 8/1997 |
| EP | 0 802 056 | | 10/1997 |
| GB | 2293142 | | 3/1996 |
| JP | 6-15839 | | 1/1994 |
| JP | 6-40043 | | 2/1994 |
| JP | 7-052404 | | 2/1995 |
| JP | 7-125232 | | 5/1995 |
| JP | 7-125239 | | 5/1995 |
| JP | 8-20115 | | 1/1996 |
| JP | 8-20116 A | * | 1/1996 |
| JP | 8-025640 | | 1/1996 |
| JP | 9-094976 | | 4/1997 |

* cited by examiner

*Primary Examiner*—Judy Nguyen
(74) *Attorney, Agent, or Firm*—Fitzpatrick, Cella, Harper & Scinto

(57) ABSTRACT

A liquid container includes a negative pressure generating member containing chamber which contains therein a negative pressure generating member formed of a fiber material and provided with a liquid supplying portion and an atmosphere communication portion. A liquid containing chamber, provided with a communicating portion communicating with the negative pressure generating member containing chamber, forms a substantially hermetically sealed space and stores therein liquid to be supplied to the negative pressure generating member. A partition wall for partitioning the negative pressure generating member containing chamber and the liquid containing chamber and forming the communicating portion, is provided with a gas introduction blocking unit which cooperates with the partition wall and the liquid contained in the negative pressure generating member containing chamber to block the introduction of gas from the communicating portion into the liquid containing chamber, except during the supply of the liquid from the liquid supplying portion to the outside.

4 Claims, 15 Drawing Sheets

LIQUID CONTAINER

BACKGROUND OF THE INVENTION

1. Field of the Invention

This invention relates to a liquid container, a method of manufacturing the container, the package of the container, an ink jet head cartridge in which the container and a recording head are made integral with each other, and a liquid discharge recording apparatus, and particularly to a liquid container suitably utilized in the field of ink jet recording or the like.

2. Related Background Art

Generally, an ink tank as a liquid container used in the field of ink jet recording is provided with a construction for adjusting the holding force of ink stored in the ink tank to well effect the supply of the ink to a recording head for discharging the ink. This holding force is for making the pressure of the ink discharging portion of the recording head negative relative to the atmosphere and is therefore called negative pressure.

As one of the easiest methods for generating such negative pressure, mention may be made of a method of providing a porous member such as urethane foam or an ink absorbing member such as felt in the ink tank, and utilizing the capillary force (ink absorbing force) of the ink absorbing member. For example, Japanese Laid-Open Patent Application No. 6-15839 discloses a construction in which a plurality of fibers differing in density from one another are compressed and packed in the whole of an ink tank in the order of high-density fiber and low-density fiber toward a supply path to a recording head. The high-density fiber has a great number of fibers per unit area and has a strong ink absorbing force, and the low-density fiber has a small number of fibers per unit area and has a weak ink absorbing force. The seams among the fibers are brought into pressure contact with each other so as to prevent the intermission of ink caused by the mixing of air.

On the other hand, the applicant of the basic application has proposed in Japanese Laid-Open Patent Application No. 7-125232, Japanese Laid-Open Patent Application No. 6-40043, etc. an ink tank provided with a liquid containing chamber of which the ink containing amount per unit area is increased in spite of an ink absorbing member being utilized and which can realize stable ink supply.

FIG. 1A of the accompanying drawings is a schematic cross-sectional view showing the construction of an ink tank utilizing the above-described construction. The interior of an ink cartridge 10 is partitioned into two spaces by a partition wall (38) having a communicating hole (communicating portion) 40. One of the two spaces provides a liquid containing chamber 36 hermetically sealed except the communicating hole 40 of the partition wall 38 and directly holding ink 25 therein, and the other space provides a negative pressure generating member containing chamber 34 containing a negative pressure generating member 32 therein. A wall surface forming this negative pressure generating member containing chamber 34 is formed with an atmosphere communicating portion (atmosphere communicating port) 12 for effecting the introduction of the atmosphere into the container resulting from the consumption of ink, and a supply port 14 for supplying the ink to a recording head portion, not shown. In FIGS. 1A and 1B, the area in which the negative pressure generating member holds the ink is indicated by hatching. The ink contained in the space is indicated by net lines.

In the above-described structure, when the ink in the negative pressure generating member 32 is consumed by the recording head, not shown, air is introduced from the atmosphere communicating port 12 into the negative pressure generating member containing chamber 34, and enters the liquid containing chamber 36 through the communicating hole 40 of the partition wall 38. Instead of this, the negative pressure generating member 32 in the negative pressure generating member containing chamber 34 is filled with the ink from the liquid containing chamber 36 through the communicating hole of the partition wall (this will hereinafter be referred to as the gas-liquid exchanging operation). Accordingly, even if the ink is consumed by the recording head, the negative pressure generating member 32 is filled with the ink in conformity with the consumed amount, and the negative pressure generating member 32 holds a predetermined amount of ink therein and keeps the negative pressure relative to the recording head substantially constant and therefore, the ink supply to the recording head becomes stable. Such an ink tank which is compact and has high use efficiency has been commercialized by the applicant of the basic application and is still used in practice.

In the example shown in FIG. 1A, an atmosphere introducing groove 50 as a structure for expediting the introduction of the atmosphere is provided near the communicating portion between the negative pressure generating member containing chamber and the ink containing chamber, and a space (buffer chamber) 44 free of the negative pressure generating member by ribs 42 is provided near the atmosphere communicating portion.

Also, the applicant of the basic application has proposed in Japanese Laid-Open Patent Application No. 8-20115 an ink tank using as the negative pressure generating member of the ink tank a fiber comprising olefin resin having thermoplasticity. This ink tank is excellent in ink storing stability and is also excellent in recycling property because the ink tank housing and the fibrous material are formed of the same kind of material.

Now, the inventors have zealously studied about a construction using a fibrous material as the negative pressure generating member of the ink tank shown in FIG. 1A with a result that it has been found that the following fact may pose a problem.

That is, when supposing the state before the start of use such as during distribution, the liquid containing chamber has been positioned and left upwardly in the direction of gravity relative to the negative pressure generating member containing chamber, as shown in FIG. 1B of the accompanying drawings, it has been found that by the air being introduced into the liquid containing chamber through the communicating portion, the liquid in the liquid containing chamber may leak to the negative pressure generating member and the ink 25 may overflow to the buffer chamber. If the ink thus overflows to the buffer chamber, the ink may overflow through the atmosphere communicating port to thereby stain a user's hand or the ink may drop from the liquid supply port to stain the user's hand or the like when the seal is broken.

The above-noted problem is considered to arise from the following characteristics of the ink absorbing member using fibers as compared with a porous material such as conventional urethane foam:

(1) since porosity is great, the pressure loss of ink movement is small;

(2) the difference between the advancing angle of contact and the retreating angle of contact of the ink with the fiber is small; and (3) in the case of the ink absorbing member using the fibers, a capillary force is created in the gaps among the fibers and therefore, the difference in the local strength of the capillary force on the scale of the cell (about 80 to 120 $\mu$m) of urethane sponge is small as compared with an ink absorbing member formed by cell film being removed after urethane foam is foamed.

This problem peculiar to a construction utilizing a fiber material as the negative pressure generating member has been recognized by the inventors for the first time.

SUMMARY OF THE INVENTION

It is a first object of the present invention to provide a liquid container which utilizes a fibrous material as a negative pressure generating member and yet solves the above-noted problem.

It is a second object of the present invention to provide a liquid container having a liquid containing chamber having both of the above-described compactness and high use efficiency and free of inadvertent inflow of liquid from the liquid containing chamber to a negative pressure generating member containing chamber, on the basis of an unconventional, novel idea found out by the inventors' study for achieving the above first object, i.e., the relation between the hardness and interface of two negative pressure generating members when they are urged against each other.

In addition, it is another object of the present invention to provide a method of manufacturing the above-described liquid container, an ink jet cartridge utilizing the above-described liquid container, etc. which will be described later.

Specific means for achieving the above objects could be understood from the following construction.

The liquid container of the present invention is a liquid container having a negative pressure generating member containing chamber containing therein a negative pressure generating member formed of a fiber material and provided with a liquid supplying portion and an atmosphere communicating portion, a liquid containing chamber provided with a communicating portion communicating with the negative pressure generating member containing chamber and forming a substantially hermetically sealed space and storing therein liquid to be supplied to the negative pressure generating member, and a partition wall for partitioning the negative pressure generating member containing chamber and the liquid containing chamber and forming the communicating portion, characterized by the provision of gas introduction blocking means cooperating with the partition wall and the liquid contained in the negative pressure generating member containing chamber to block the introduction of gas from the communicating portion into the liquid containing chamber except during the supply of the liquid from the liquid supplying portion to the outside.

According to the above-described liquid container, irrespective of the posture of the liquid container, the introduction of gas from the communicating portion into the liquid containing chamber except during the supply of the liquid from the liquid supplying portion to the outside is blocked by the liquid contained in the negative pressure generating member formed of a fiber material and the gas introduction blocking means, whereby the first object is achieved.

On the other hand, during the liquid supplying operation, the liquid is consumed from the negative pressure generating member and therefore, the gas introduction blocking means permits the gas-liquid exchanging operation and can therefore realize a stable liquid supplying operation while keeping the negative pressure in the liquid supplying portion substantially constant.

Also, a liquid container according to another embodiment of the present invention is characterized in that in a negative pressure generating member containing chamber, between a first negative pressure generating member on the communicating portion side with a liquid containing chamber and a second negative pressure generating member on the atmosphere communicating portion side, there is a boundary layer of a capillary force stronger than the capillary force of the second negative pressure generating member, and is structured such that through this layer, the atmosphere communicating portion and the communicating portion with the liquid containing chamber communicate with each other without fail. The liquid container is also characterized in that in the state before the start of use as during distribution, in whatever direction the ink tank may be left as it is, the difference between the capillary force of the second negative pressure generating member and the capillary force of the boundary layer is equal to or greater than the difference between the water head of the ink-atmosphere interface in the second negative pressure generating member and the water head of the ink-atmosphere interface of the boundary layer.

In the above-described construction, the ink-atmosphere interface sometimes flows in the second negative pressure generating member, but it never happens that the ink-atmosphere interface in the boundary layer flows, because the ink in the boundary layer is always held by a capillary force equal to or greater than the difference in water head from the ink in the second negative pressure generating member. Thus, the boundary layer is always filled with the ink and therefore, the atmosphere can be prevented from flowing into the first negative pressure generating member and the liquid containing chamber through the boundary layer. Accordingly, ink exceeding the amount of ink which can be held in the negative pressure generating member containing chamber can be suppressed from flowing in from the liquid containing chamber, thereby achieving the first object. As a further embodiment, the capillary forces of the two negative pressure generating members themselves may be made to differ from each other, instead of the above-described boundary layer strong in capillary force.

Also, a liquid container according to still another embodiment of the present invention is a liquid container having a negative pressure generating member containing chamber containing therein first and second negative pressure generating members urged against each other and provided with a liquid supplying portion and an atmosphere communicating portion, a liquid containing chamber provided with a communicating portion communicating with the negative pressure generating member containing chamber and forming a substantially hermetically sealed space and storing therein liquid to be supplied to the negative pressure generating member, and a partition wall for partitioning the negative pressure generating member containing chamber and the liquid containing chamber and forming the communicating portion, characterized in that the interface of the urged portions of the first and second negative pressure generating members intersects with the partition wall, the first negative pressure generating member communicates with the communicating portion and can communicate with the atmosphere communicating portion only through the interface of the urged portions, the second negative pressure generating member can communicate with the communicating portion only through the interface of the urged portions, one of the first and second negative pressure generating members which is weak in capillary force is harder than the other negative pressure generating member and the negative pressure generating member containing chamber is filled with an amount of liquid which can be held by the entire interface of the urged portions irrespective of the posture of the liquid containing chamber, thereby achieving the second object.

Also, the present invention provides a method of manufacturing the above-described liquid container, a package as a form of the container as during distribution thereof, an ink jet head cartridge in which the container and a recording head are made integral with each other, and a recording apparatus.

The method of manufacturing the liquid container of the present invention is a method of manufacturing a liquid container having a negative pressure generating member containing chamber containing therein a first negative pressure generating member and a second negative pressure generating member urged against each other, the second negative pressure generating member being harder than the first negative pressure generating member, the negative pressure generating member containing chamber being provided with a liquid supplying portion and an atmosphere communicating portion, a liquid containing chamber provided with a communicating portion communicating with the negative pressure generating member containing chamber and forming a substantially hermetically sealed space and storing therein liquid to be supplied to the negative pressure generating members, and a partition wall for partitioning the negative pressure generating member containing chamber and the liquid containing chamber and forming the communicating portion, wherein the interface of the urged portions of the first and second negative pressure generating members intersects with the partition wall, the first negative pressure generating member communicates with the communicating portion and can communicate with the atmosphere communicating portion only through the interface of the urged portions, and the second negative pressure generating member can communicate with the communicating portion only through the interface of the urged portions, characterized by the provision of the preparing step of preparing a main body in which a recess for the negative pressure generating member containing chamber provided with the liquid supplying portion and a recess for the liquid containing chamber are formed integrally with the partition wall provided with the communicating portion, the first inserting step of inserting the first negative pressure generating member into the recess for the negative pressure generating member containing chamber of the main body, the first compressing step of making the first negative pressure generating member bear against the bottom surface of the recess after the first inserting step, and compressing the first negative pressure generating member in the insertion direction while sliding it relative to the inner side of the recess for the negative pressure generating member containing chamber, the second inserting step of inserting the second negative pressure generating member into the recess for the negative pressure generating member containing chamber of the main body after the first inserting step, the second compressing step of urging the second negative pressure generating member against the first negative pressure generating member and compressing it in the inserting direction while sliding it relative to the inner side of the recess for the negative pressure generating member containing chamber, after the first compressing step, and the enclosing step of fixing to the main body a lid member provided with an opening for the atmosphere communicating portion and covering both of the two recesses, thereby forming the negative pressure generating member containing chamber and the liquid containing chamber.

According to the above-described manufacturing method, the first negative pressure generating member which is not hard as compared with the second negative pressure generating member is compressed in advance in the container, thereby making the first negative pressure generating member easy to deform more preferentially when the two capillary force generating members are urged against each other, whereby the intimate contacting property of the surfaces of the two negative pressure generating members which bear against each other and the manufacturing irregularity of the positions of those surfaces relative to the main body of the container can be suppressed. As the result, the above-described container can be manufactured inexpensively and easily.

Also, a method of manufacturing a liquid container according to another embodiment of the present invention is characterized by the step of preparing a liquid container having a negative pressure generating member containing chamber containing therein first and second negative pressure generating members urged against each other and provided with a liquid supplying portion and an atmosphere communicating portion, a liquid containing chamber provided with a communicating portion communicating with the negative pressure generating member containing chamber and forming a substantially hermetically sealed space and storing therein liquid to be supplied to the negative pressure generating members, and a partition wall for partitioning the negative pressure generating member containing chamber and the liquid containing chamber and forming the communicating portion, wherein the interface of the urged portions of the first and second negative pressure generating members intersects with the partition wall, the first negative pressure generating member communicates with the communicating portion and can communicate with the atmosphere communicating portion only through the interface of the urged portions, the second negative pressure generating member can communicate with the communicating portion only through the interface of the urged portions, and the capillary force of the interface of the urged portions is higher than the capillary forces of the first and second negative pressure generating members, the first liquid filling step of filling the liquid containing chamber with liquid, and the second liquid filling step of filling the negative pressure generating member containing chamber with an amount of liquid which can be held by the entire interface of the urged portions irrespective of the posture of the liquid container.

The package of the present invention contains the above-described liquid container therein, and is characterized by the provision of seal means for closing the atmosphere communicating portion and liquid supplying portion of the container, and means for opening the seal means.

Also, the ink jet head cartridge of the present invention is characterized by the provision of the above-described liquid container, and a liquid discharging head portion capable of discharging liquid contained in the container.

The liquid discharging recording apparatus of the present invention is characterized by the provision of the above-described liquid container, a liquid discharging head portion capable of discharging liquid contained in the container, and a mounting portion for the liquid container.

Regarding the insertion of the above-described negative pressure generating members, the form thereof is not restricted to the container provided with the liquid containing chamber.

So, on the basis of the above-described novel idea, a method of manufacturing a liquid container according to still another embodiment of the present invention is a method of manufacturing a liquid container containing thereon a first negative pressure generating member and a second negative pressure generating member urged against each other, the second negative pressure generating member being-harder than the first negative pressure generating member, characterized by the provision of the preparing step of preparing a main body provided with a recess provided with a bottom surface bearing against the first negative pressure generating member, the first inserting step of inserting the first negative pressure generating member into a recess for the negative pressure generating member containing chamber of the main body, the first compressing step of making the first negative pressure generating member bear against the bottom surface of the recess after the first inserting step, and compressing the first negative pressure generating member in the inserting direction while sliding it relative to the inner side of the recess for the negative pressure generating member containing chamber, the second inserting step of inserting the second negative pressure generating member into the recess for the negative pressure generating member containing chamber of the main body after the first inserting step, the second compressing step of urging the second negative pressure generating member against the first negative pressure generating member after the first compressing step, and compressing the second negative pressure generating member in the inserting direction while sliding it relative to the inner side of the recess for the negative pressure generating member containing chamber, and the enclosing step of fixing a lid member for covering the recess to the main body.

According to the above-described manufacturing method, when a plurality of capillary force generating members are inserted into the container, the control of the intimate contact state can be effected easily, and a container provided with a plurality of capillary force generating members can be manufactured easily with little manufacturing irregularity.

In addition, the present invention also provides a container manufactured by the above-described manufacturing method. A liquid container according to yet still another embodiment of the present invention is a liquid container provided with first and second negative pressure generating members urged against each other, a container body provided with a recess containing the first and second negative pressure generating members, and a lid member covering the opening portion of the container body with the first and second negative pressure generating members contained in the container body, characterized in that the second negative pressure generating member is hard as compared with the first negative pressure generating member, the first negative pressure generating member bears against the bottom surface of the recess of the container body, and that surface of the first negative pressure generating member which is opposed to the bottom surface bears against the second negative pressure generating member.

According to the above-described liquid container, a container provided with a plurality of capillary force generating members can be manufactured easily with little manufacturing irregularity by the above-described manufacturing method.

The "hardness" of the negative pressure generating members in the present invention is the "hardness" of the negative pressure generating members when contained in the liquid container, and is prescribed by the inclination (unit: kgf/mm) of the repulsion to the amount of deformation of the negative pressure generating members.

As regards the magnitude of the "hardness" of the two negative pressure generating members, that negative pressure generating member in which the inclination of the repulsion to the amount of deformation is greater is called the "hard negative pressure generating member".

DESCRIPTION OF THE PREFERRED EMBODIMENTS

The details of some embodiments of the present invention will hereinafter be described with reference to the drawings.

While in the following embodiments, description is made with ink taken as an example of liquid used in the liquid supplying method and liquid supplying system of the present invention, the liquid applicable is not limited to ink, but for example, in the field of ink jet recording, the liquid of course includes treating liquid for a recording medium, etc.

Also, in each cross-sectional view, an area in which negative pressure generating members hold ink is indicated by hatching, and the ink contained in a space is indicated by net lines.

First Embodiment

Figure 2A:
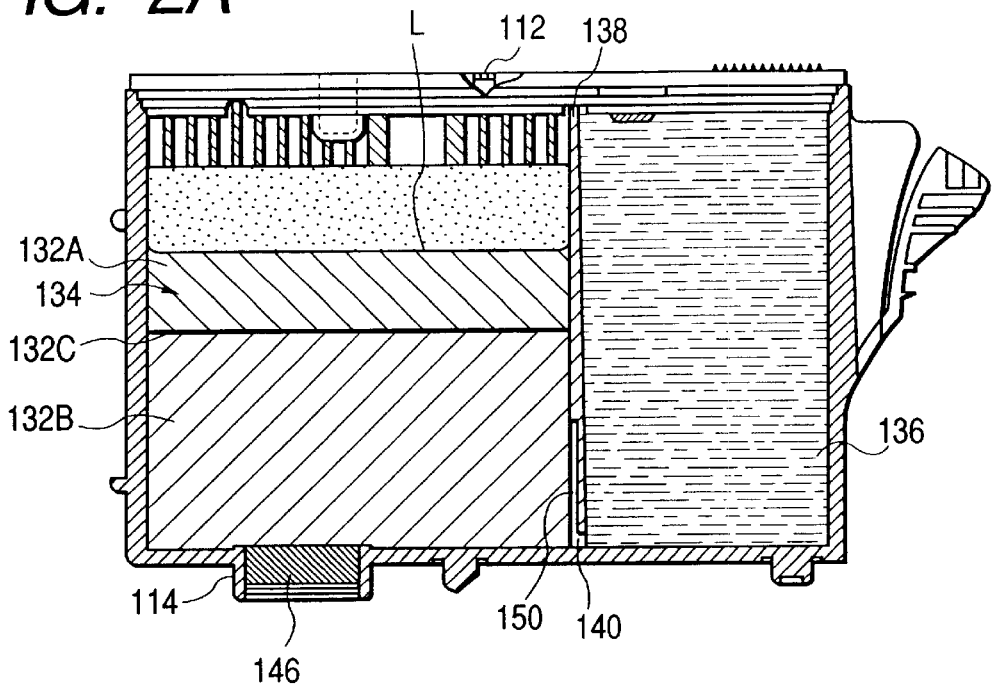
FIGS. 2A and 2B are schematic illustrations for illustrating a first embodiment of the present invention, FIG. 2A being a cross-sectional view, and FIG. 2B being a cross-sectional view when the liquid containing chamber side of a container is upward.
Figure 2B:
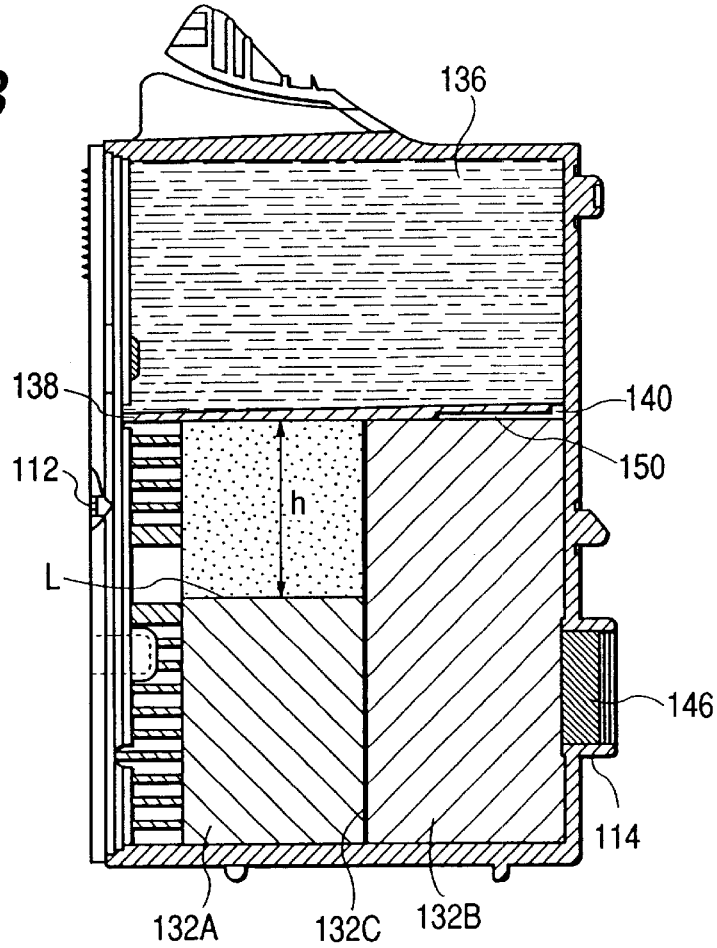

FIGS. 2A and 2B are schematic illustrations of a liquid container according to a first embodiment of the present invention, FIG. 2A being a cross-sectional view, and FIG. 2B being a cross-sectional view when the liquid containing chamber side of the container is upward.

In FIG. 2A, the liquid container (ink tank) 100 is partitioned by a partition wall 138 into a negative pressure generating member containing chamber 134 communicating in the upper portion thereof with the atmosphere through an atmosphere communicating port 112 and communicating in the lower portion thereof with an ink supply port and containing negative pressure generating members therein, and a substantially hermetically sealed liquid containing chamber 136 containing ink as liquid therein. The negative pressure generating member containing chamber 134 and the liquid containing chamber 136 communicate with each other only through a communicating portion 140 formed in the partition wall 138 near the bottom of the ink tank 100 and an atmosphere introduction path 150 for expediting the introduction of the atmosphere into the liquid containing chamber during the liquid supplying operation. A plurality of ribs are integrally formed in an inwardly protruding form on the upper wall of the ink tank 100 which defines the negative pressure generating member containing chamber 134, and bear against negative pressure generating members contained in the negative pressure generating member containing chamber 134 in their compressed state. By these ribs, an air buffer chamber is formed between the upper wall and the upper surfaces of the negative pressure generating members.

Also, an urging member 146 higher in capillary force and greater in physical strength than the negative pressure generating members is provided in an ink supply cylinder provided with a supply port 114, and is urged against the negative pressure generating members.

As the negative pressure generating members, two capillary force generating type negative pressure generating members, i.e., a first negative pressure generating member 132B and a second negative pressure generating member 132A formed of fibers of olefin resin such as polyethylene, are contained in the negative pressure generating member containing chamber in the present embodiment. The reference character 132C designates the boundary layer between these two negative pressure generating members, and that portion of the boundary layer 132C which intersects with the partition wall 138 is present above the upper end portion of the atmosphere introduction path 150 in the posture of the liquid container during its use in which the communicating portion is downward (FIG. 2A). Also, the ink contained in the negative pressure generating members is present up to above the boundary layer 132C, as indicated by the liquid surface L of the ink.

The boundary layer between the first negative pressure generating member and the second negative pressure generating member is urged, and the vicinity of the boundary layer between the negative pressure generating members is high in compressibility and strong in capillary force as compared with the other regions. That is, when the capillary force of the first negative pressure generating member is defined as $P_1$ and the capillary force of the second negative pressure generating member is defined as $P_2$ and the capillary force of the interface between the negative pressure generating members is defined as $P_s$, $P_2<P_1<P_s$.

The state of the liquid contained in such a liquid container when its posture has been changed during its non-use will now be described with reference to FIG. 2B.

FIG. 2B shows a posture in which the liquid containing chamber is vertically upward as may occur, for example, during distribution or the like. When the liquid container is left in such a posture, the ink in the negative pressure generating members moves from a portion in which the capillary force is low to a portion in which the capillary force is high, and a water head difference is created between the water head of the interface L between the ink and the atmosphere and the water head of the ink contained in the boundary layer 132C between the negative pressure generating members. Here, when this water head difference is greater than the difference between the capillary forces $P_2$ and $P_s$, the ink contained in the interface 132C tries to flow into the second negative pressure generating member 132A until this water head difference becomes equal to the difference between the capillary forces $P_2$ and $P_s$.

In the ink tank of the present embodiment, however, the water head difference is smaller than (or equal to) the difference between the capillary forces $P_2$ and $P_s$ and therefore, the ink contained in the interface 132C is held and the amount of the ink contained in the second negative pressure generating member does not increase.

In the case of the other posture, the difference between the water head of the ink-atmosphere interface L and the water head of the ink contained in the interface 132C between the negative pressure generating members becomes still smaller than the difference between the capillary forces $P_2$ and $P_s$ and therefore, the interface 132C can keep a state in which it has ink in the whole area thereof, irrespective of its posture. Therefore, in any posture, the interface 132C cooperates with the partition wall and the ink contained in the negative pressure generating member containing chamber to function as gas introduction blocking means for blocking the introduction of gas from the communicating portion 140 and the atmosphere introduction path 150 into the liquid containing chamber and thus, it never happens that the ink overflows from the negative pressure generating members.

In the case of the present embodiment, the first negative pressure generating member is a capillary force generating type negative pressure generating member ($P_1$=−110 mm Aq.) using an olefin resin fiber material (2 deniers), and the hardness thereof is 0.69 kgf/mm. (The hardness of the capillary force generating member was found by measuring the repulsion when it was pushed in by a push bar of $\phi$ 15 mm in a state in which it was contained in the negative pressure generating member containing chamber, and the inclination of the repulsion to the amount of push-in.) On the other hand, the second negative pressure generating member is a capillary force generating type negative pressure generating member using the same olefin resin fiber material as that of the first negative pressure generating member, but is weak in capillary force ($P_2$=−80 mm Aq.), great in the fiber diameter of the fiber material (6 deniers) and high in the rigidity of the absorbing member (1.88 kgf/mm).

The capillary force generating members are combined so that as described above, the negative pressure generating member weak in capillary force may become hard relative to the negative pressure generating member high in capillary force, and they are urged against each other, whereby the interface between the negative pressure generating members in the present embodiment can make the strength of the capillary force such that $P_2<p_1<P_s$ by the first negative pressure generating member being crushed. Further, the difference between $P_2$ and $P_s$ can be made equal to or greater than the difference between $P_2$ and $P_1$ without fail and therefore, as compared with a case where the two negative pressure generating members are simply made to bear against each other, the ink can be reliably held in the boundary layer between the capillary force generating members.

In the present embodiment, as described above, provision is made of a boundary layer strong in capillary force, whereby even if the ranges of the capillary forces $P_1$ and $P_2$ taking the irregularity of density into account overlap each other due to the irregularity of density in the negative pressure generating members, the inadvertent inflow of the ink into the negative pressure generating member containing chamber during non-use as described above can be prevented because the interface has a capillary force satisfying the above-mentioned condition.

Here, the capillary forces of the two negative pressure generating members themselves can suitably assume desired values so as to make the ink supply characteristic during use excellent in a state in which the conditions that $P_1<P_s$ and $P_2<P_s$ are satisfied. In the present embodiment, by bringing about $P_2<P_1$, the influence of the irregularity of the capillary forces of the capillary force generating members themselves is suppressed during the use of the liquid container, and the ink in the upper negative pressure generating member is reliably consumed to thereby make the ink supply characteristic excellent.

Second Embodiment

Figure 3A:
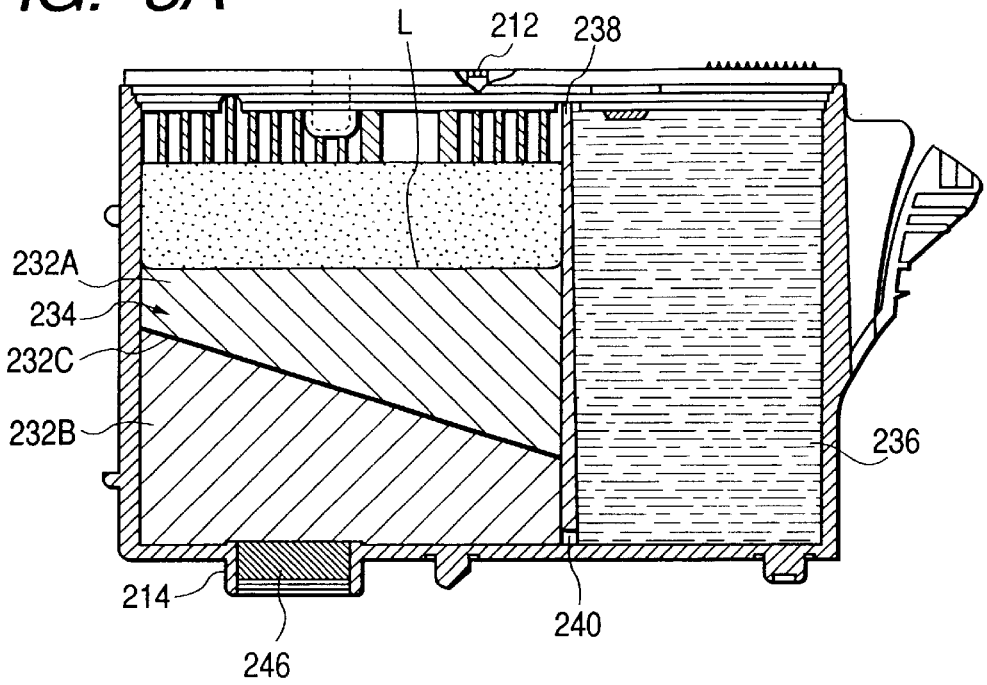
FIGS. 3A and 3B are schematic illustrations for illustrating a second embodiment of the present invention, FIG. 3A being a cross-sectional view, and FIG. 3B being a cross-sectional view when the liquid containing chamber side of a container is upward.
Figure 3B:
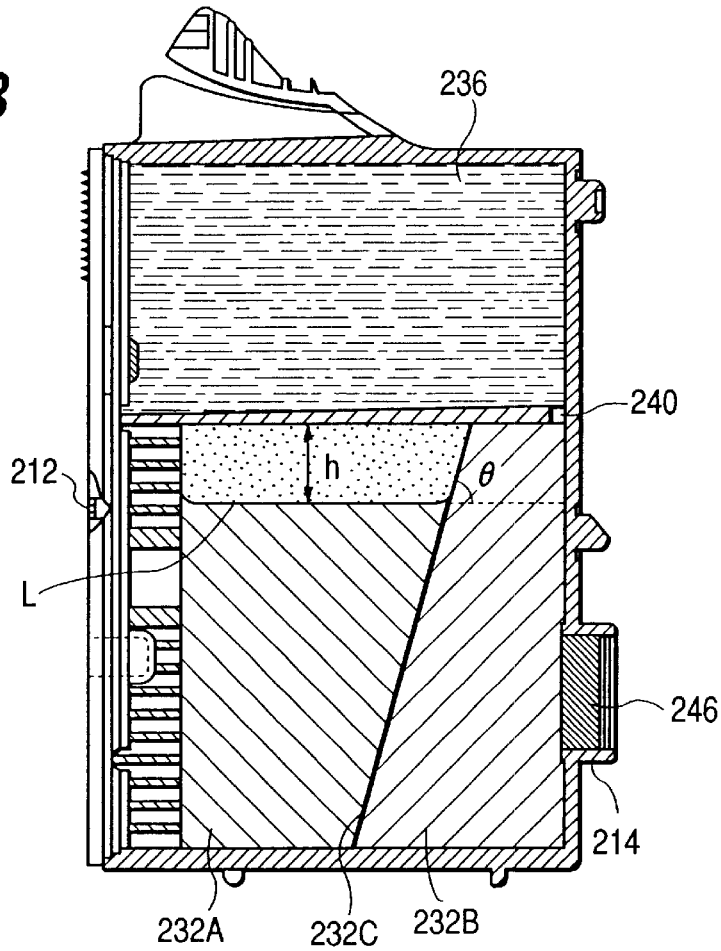

FIGS. 3A and 3B are schematic illustrations of a liquid container according to a second embodiment of the present invention, FIG. 3A being a cross-sectional view, and FIG. 3B being a cross-sectional view when the liquid containing chamber side of the container is upward. In the present embodiment, the construction of a negative pressure generating member containing chamber differs from that in the afore described first embodiment.

In FIG. 3A, the reference numeral 234 designates a negative pressure generating member containing chamber, the reference character 232B denotes a first negative pressure generating member, the reference character 232A designates a second negative pressure generating member, the reference character 232C denotes the boundary layer between the first negative pressure generating member and the second negative pressure generating member, the reference numeral 212 designates an atmosphere communicating portion, the reference numeral 214 denotes a supply port, the reference numeral 246 designates an urging member, the reference numeral 236 denotes a liquid containing chamber, and the reference numeral 240 designates the communicating portion between the negative pressure generating member containing chamber and the liquid containing chamber.

Also, as in the first embodiment, the ink-atmosphere interface in the negative pressure generating members is denoted by L.

In the present embodiment, the boundary layer is not orthogonal to the partition wall unlike the first embodiment, but is designed to have an angle θ (0<θ<90°) with respect to the a horizontal direction when as shown in FIG. 3B, the liquid containing chamber is right above.

Accordingly, in the state shown in FIG. 3B, if the volume is the same as the volume of the second negative pressure generating member in the first embodiment, the water head difference h becomes small as compared with the first embodiment. Instead, consideration can be given to the relation between the water head difference and the capillary force in a state in which the boundary layer is orthogonal to the horizontal direction.

In the present embodiment, both of the negative pressure generating members use a plurality of heat-molded thermoplastic fiber materials having different melting points (in the present embodiment, compound fiber of polypylene and polyethylene). Here, by the temperature when the fiber materials are heat-molded being set to between the melting point of the material having a low melting point and the melting point of the material having a high melting point (e.g. to a temperature higher the melting point of polyethylene and lower than the melting point of polypropylene), the fiber material having a low melting point can be utilized as an adhesive agent.

In the present embodiment, this is utilized to set the rate at which the negative pressure generating member of a weak capillary force occupies the fiber material having the low melting point to a rate great as compared with that of the negative pressure generating member of a high capillary force, whereby the negative pressure generating member of the weak capillary force is made hard as compared with the negative pressure generating member of the high capillary force so that the capillary force of the boundary layer may reliably become higher than that of the negative pressure generating member of the high capillary force. Instead of changing the rate of the fiber material, the heat molding time of the negative pressure generating member to be made hard may be lengthened. Of course, the above-described setting of the fiber is applicable to the first embodiment, and it is also possible to apply to the present embodiment the combination of different fiber diameters applied to the first embodiment.

In the above-described first and second embodiments, the capillary force of the boundary layer between the two negative pressure generating members is made higher than the capillary forces of the respective negative pressure generating members to thereby use the boundary layer as gas introduction blocking means, but as a modification of the respective embodiments, two negative pressure generating members having different capillary forces may simply be made to bear against each other. In this case, the difference between the capillary forces of the two negative pressure generating members is made greater than the irregularity of the capillary forces in the respective negative pressure generating members, whereby the influence of manufacturing irregularity can be suppressed. However, when the difference between the capillary forces of the two negative pressure generating members cannot be made so great or when the irregularity of the capillary forces in the negative pressure generating members is great, it is desirable that as in each of the above-described embodiments, the capillary force of the boundary layer be made higher than the capillary forces of the respective negative pressure generating members.

Third Embodiment

Figure 4A:
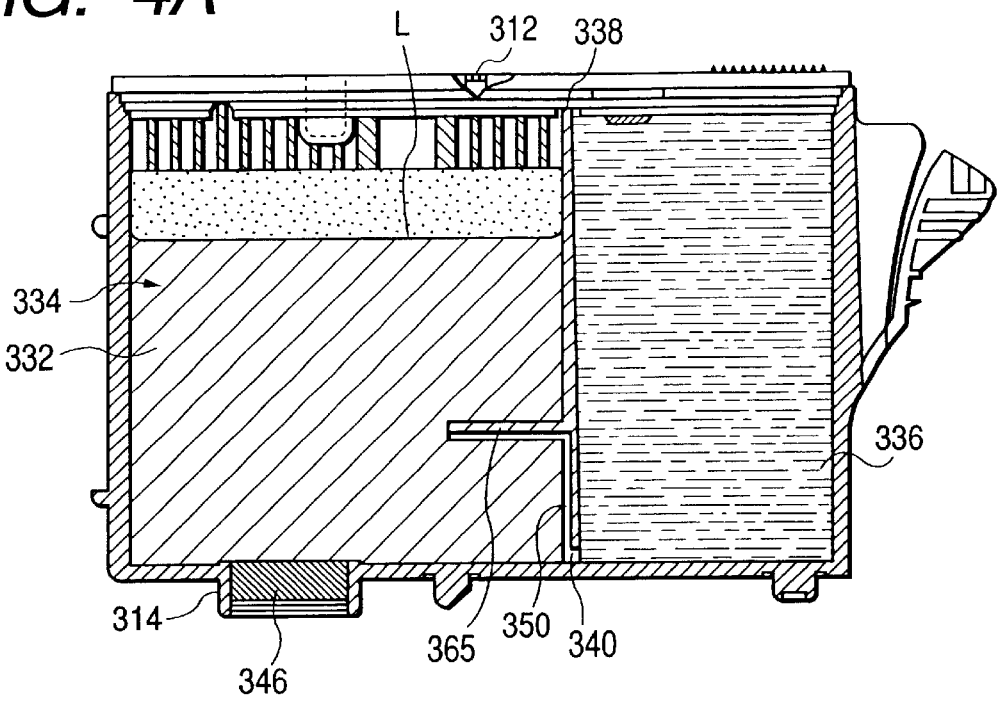
FIGS. 4A and 4B are schematic illustrations for illustrating a third embodiment of the present invention, FIG. 4A being a cross-sectional view, and FIG. 4B being a cross-sectional view when the liquid containing chamber side of a container is upward.
Figure 4B:
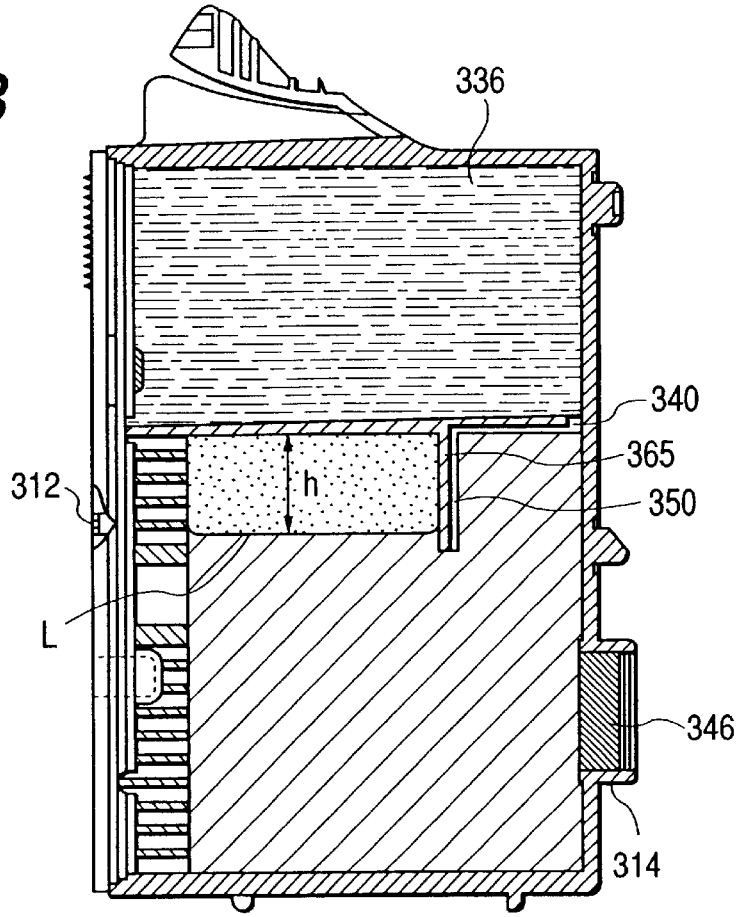

FIGS. 4A and 4B are schematic illustrations of a liquid container according to a third embodiment of the present invention, FIG. 4A being a cross-sectional view, and FIG. 4B being a cross-sectional view when the liquid containing chamber side of the container is upward. In the present embodiment, the construction of a negative pressure generating member containing chamber differs from that in the aforedescribed first and second embodiments.

In FIG. 4A, the reference numeral 334 designates a negative pressure generating member containing chamber, the reference numeral 332 denotes a negative pressure generating member, the reference numeral 312 designates an atmosphere communicating portion, the reference numeral 314 denotes a supply port, the reference numeral 346 designates an urging member, the reference numeral 336 denotes a liquid containing chamber, and the reference numeral 340 designates the communicating portion between the negative pressure generating member containing chamber and the liquid containing chamber. Also, as in the first embodiment, the ink-atmosphere interface in the negative pressure generating member is denoted by L.

In the present embodiment, a protruding portion 365 protruding toward the negative pressure generating member containing chamber side is provided on a partition wall 338, instead of providing two kinds of negative pressure generating members.

In the present embodiment, as shown in FIG. 4B, this protruding portion cooperates with the liquid contained in the negative pressure generating member to block the introduction of gas into the liquid containing chamber during non-use, and the inflow of the ink from the liquid containing chamber into the negative pressure generating member can be suppressed.

Figure 5A:
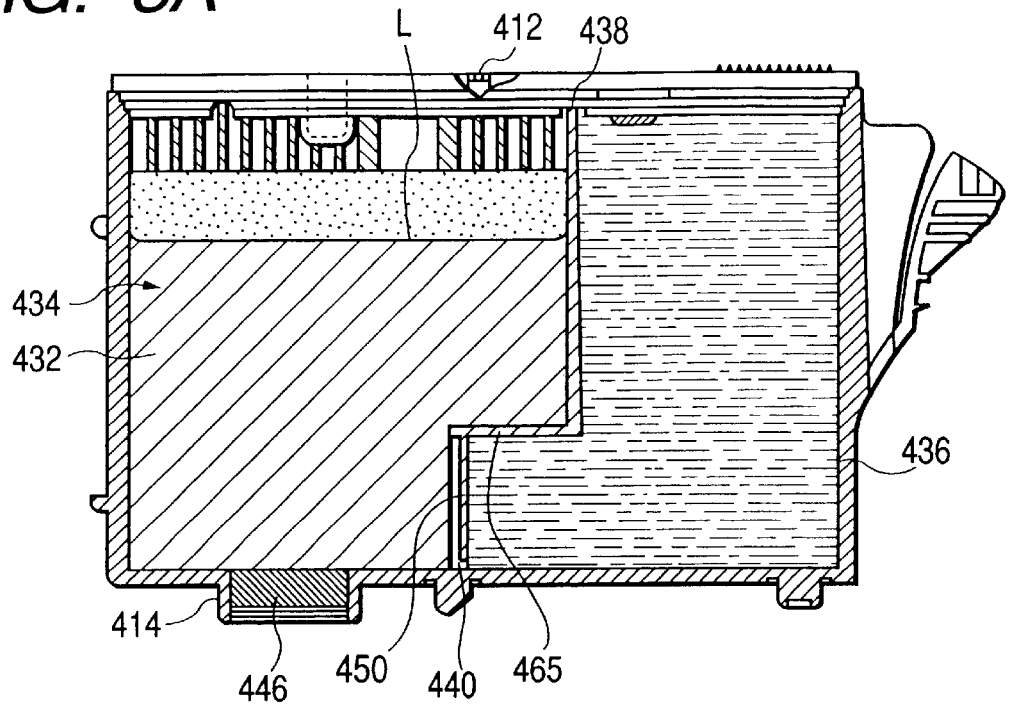
FIGS. 5A and 5B are schematic illustrations for illustrating a modification of the third embodiment of the present invention, FIG. 5A being a cross-sectional view, and FIG. 5B being a cross-sectional view when the liquid containing chamber side of a container is upward.
Figure 5B:
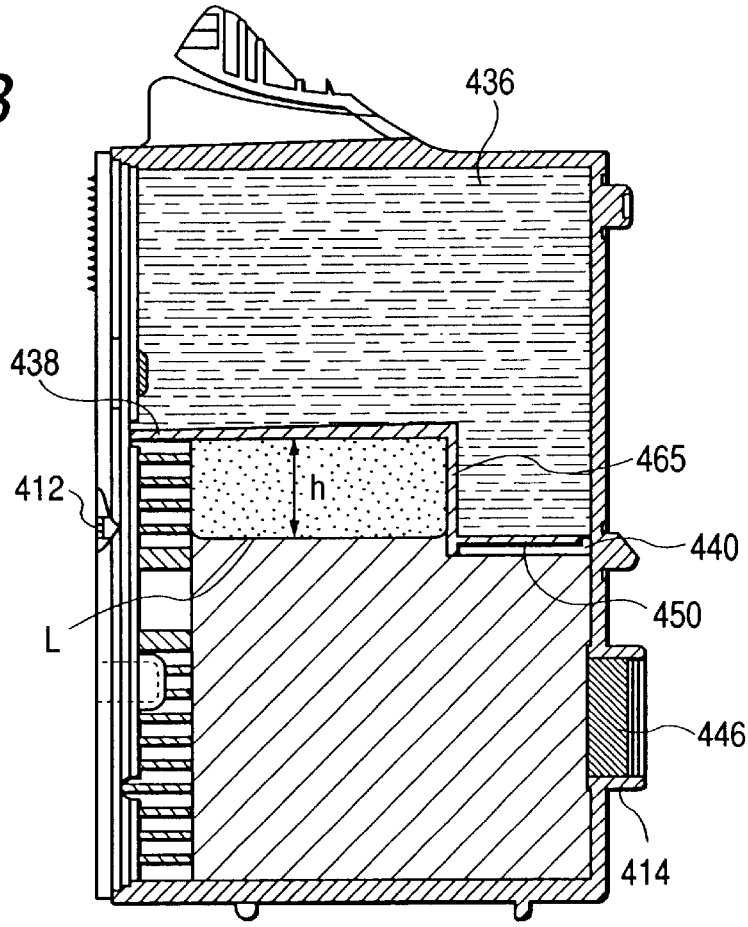

Also, a modification of the protruding portion may be of a shape as shown at 465 in FIGS. 5A and 5B wherein the partition wall is provided with a level difference. In FIG. 5A, the reference numeral 434 denotes a negative pressure generating member containing chamber, the reference numeral 432 designates a negative pressure generating member, the reference numeral 412 denotes an atmosphere communicating portion, the reference numeral 414 designates a supply port, the reference numeral 446 denotes an urging member, the reference numeral 436 designates a liquid containing chamber, and the reference numeral 440 denotes the communicating portion between the negative pressure generating member containing chamber and the liquid containing chamber.

This modification is characterized in that the volume of the liquid containing chamber can be made great relative to the third embodiment.

Other Embodiments

While the embodiments of the present invention have been described above, other embodiments applicable to the above-described embodiments will hereinafter be described. In the following description, the invention is applicable to each embodiment unless otherwise specified.

<Structure of the Liquid Container>

First, a further negative pressure control mechanism which can be suitably utilized in a container having an atmosphere introduction path like that of the first embodiment will be described with reference to FIGS. 6 and 7A to 7C.

Figure 6:
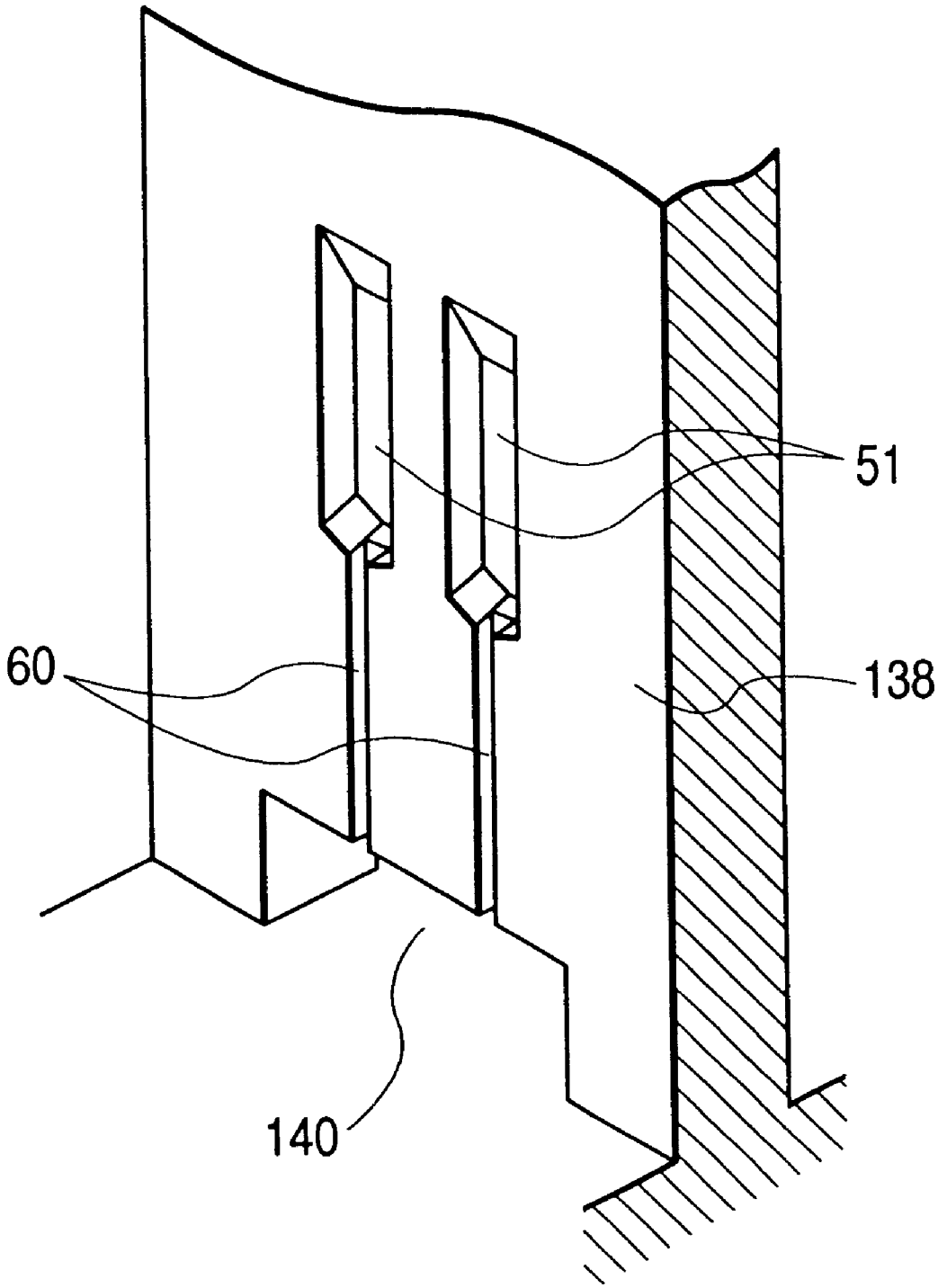
FIG. 6 is a perspective view showing the essential portions of a modification of the liquid container of the present invention.

FIG. 6 is an enlarged view of essential portions showing a modification of the atmosphere introduction path of the liquid container according to the first embodiment shown in FIGS. 2A and 2B.

In the present modification, two first passageways 51 of an atmosphere introducing path having its upper end bearing against and opening into an absorbing member as a negative pressure generating member, and two second passageways 60 communicating with the first passageways 51 and having their lower ends communicating with a communication port 140 are formed in parallelism to each other on a negative pressure generating member containing chamber side below a partition wall 138. An atmosphere introducing groove is constituted by these first passageways 50 and second passageways 60, and a portion of the second passageways 60 has a capillary force generating portion. This form ensures the reliability of atmosphere introduction and reduces the resistance at the start of the gas-liquid exchange because the first passageways 51 larger than the second passageways 60 are provided. The second passageways 60, as will be described later, can be regarded as capillary tubes generating capillary forces by a groove surface in the partition wall and a surface on the absorbing member side.

Figure 7A:
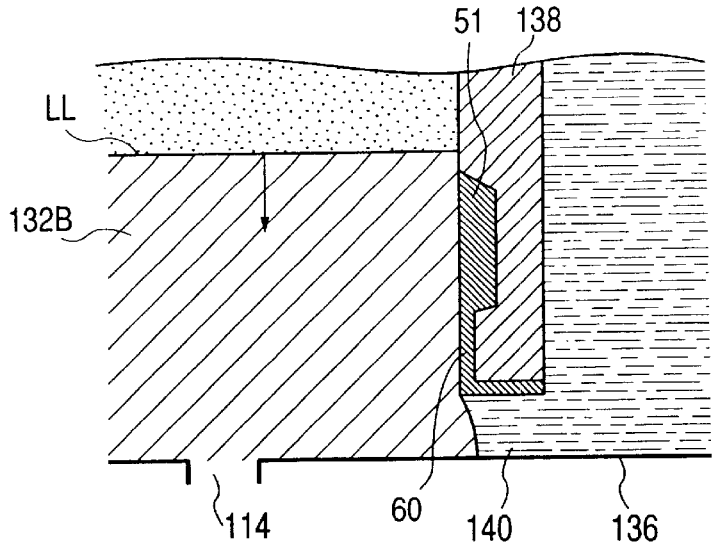
FIGS. 7A, 7B and 7C are schematic cross-sectional views for illustrating the principle of operation during the leading-out of liquid of the liquid container having the structure of FIG. 6.

The principle of operation of the liquid container according to the present modification will now be described in detail with reference to FIGS. 7A to 7C.

A number of capillary tubes can be regarded as being formed in a negative pressure generating member (absorbing member) 132B contained in the negative pressure generating member containing chamber, and negative pressure is generated by the meniscus force thereof. Usually, in the liquid container, immediately after the start of its use, the absorbing member which is the negative pressure generating member is impregnated with sufficient ink and therefore, the level of the water head in each apparent capillary tube is located at a sufficiently high level.

When the ink is consumed through an ink supply port 114, the pressure of the bottom of the negative pressure generating member containing chamber lowers and the water head in each apparent capillary tube also lowers. That is, as shown in FIG. 7A, the gas-liquid interface LL of the negative pressure generating member 132B lowers in accordance with the consumption of the ink.

Figure 7B:
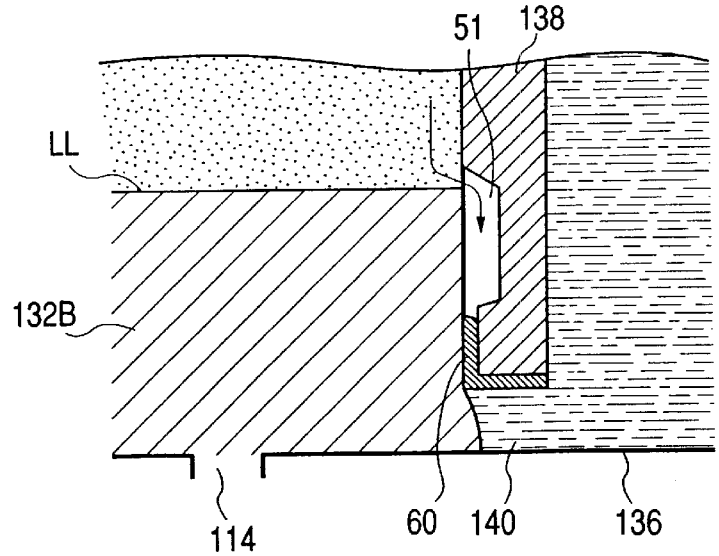
Figure 7C:
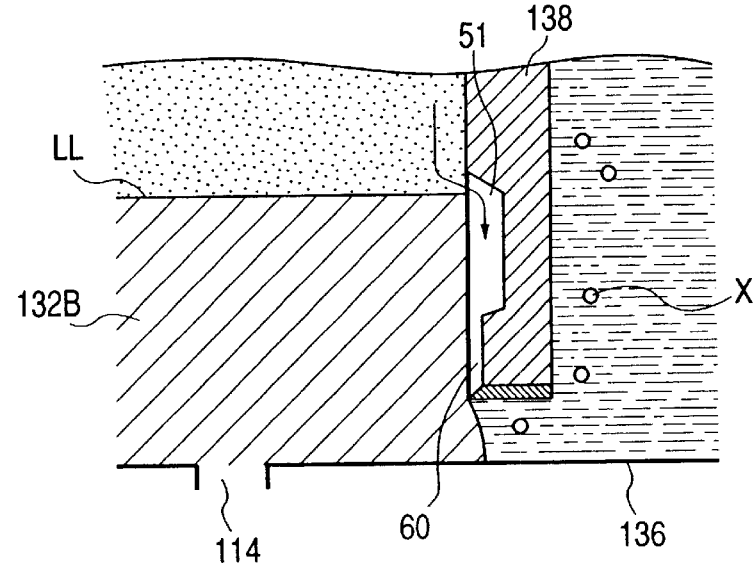

When the ink is further consumed, the gas-liquid interface LL lowers and assumes a state shown in FIG. 7B, and the upper ends of the first passageways 51 of the atmosphere introducing path become located above the gas-liquid interface LL, and the atmosphere enters the first passageways 51. At this time, a capillary force h generated in the second passageways 60 which are capillary force generating portions is set so as to become small as compared with the capillary force $H_s$ of the apparent capillary tubes of the absorbing member 132B and therefore, the meniscus in the second passageways 60 is broken by the further consumption of the ink, and as shown in FIG. 7C, the atmosphere X is introduced into the liquid containing chamber 136 through the second passageways 60 and the communication port 140 without the gas-liquid interface LL lowering.

When the atmosphere X is introduced into the liquid containing chamber 136, the pressure in the liquid containing chamber 136 becomes correspondingly higher than the pressure in the bottom of the negative pressure generating member containing chamber, and correspondingly to the elimination of the pressure difference, the ink is supplied from the liquid containing chamber 136 into the negative pressure generating member containing chamber. Thereupon, the pressure becomes higher than the negative pressure generated by the second passageways 60 and the ink flows into the second passageways 60 to thereby form a meniscus and therefore, the further introduction of the atmosphere into the liquid containing chamber 136 is stopped.

When the ink is further consumed, the meniscus in the second passageways 60 is again broken without the gas-liquid interface LL lowering, as described above, and the atmosphere is introduced into the liquid containing chamber 136. Accordingly, after the gas-liquid interface LL has reached the upper ends of the first passageways 51 of the atmosphere introducing path, the destruction and reproduction of the meniscus in the second passageways 60 are repeated during the consumption of the ink without the gas-liquid interface LL lowering, in other words, while the upper end of the atmosphere introducing path maintains its communication with the atmosphere and thus, the negative pressure generated in the liquid container is controlled substantially constantly. This negative pressure is determined by the force with which the atmosphere breaks the meniscus in the second passageways 60, and is determined by the dimension of the second passageways 60 and the characteristics (surface tension, contact angle and density) of the ink used, as described above.

Accordingly, if the capillary force h generated in the second passageways 60 which are capillary force generating portions is set so as to be between the lower limit value and upper limit value of the capillary force which may differ depending on the color and kind of the ink or treating liquid which is a liquid for discharge contained in the liquid containing chamber, a liquid container of the same structure can be used for all kinds of ink or treating liquid without the structure of the liquid container being changed.

<Method of Manufacturing the Liquid Container>

Description will now be made of a method of manufacturing the liquid container of the present invention.

Usually, when the negative pressure generating members are to be inserted into the container body, an absorbing member held in a frame member is pushed out into the container body by a rigid member such as a cylinder.

Figure 1A:
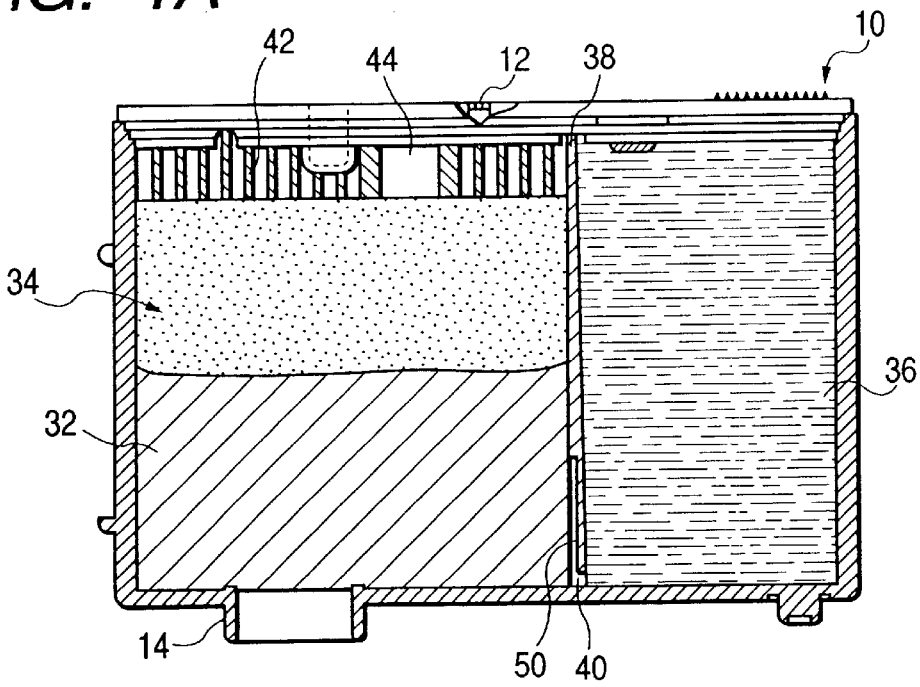
FIGS. 1A and 1B illustrate an example of the prior art.
Figure 1B:
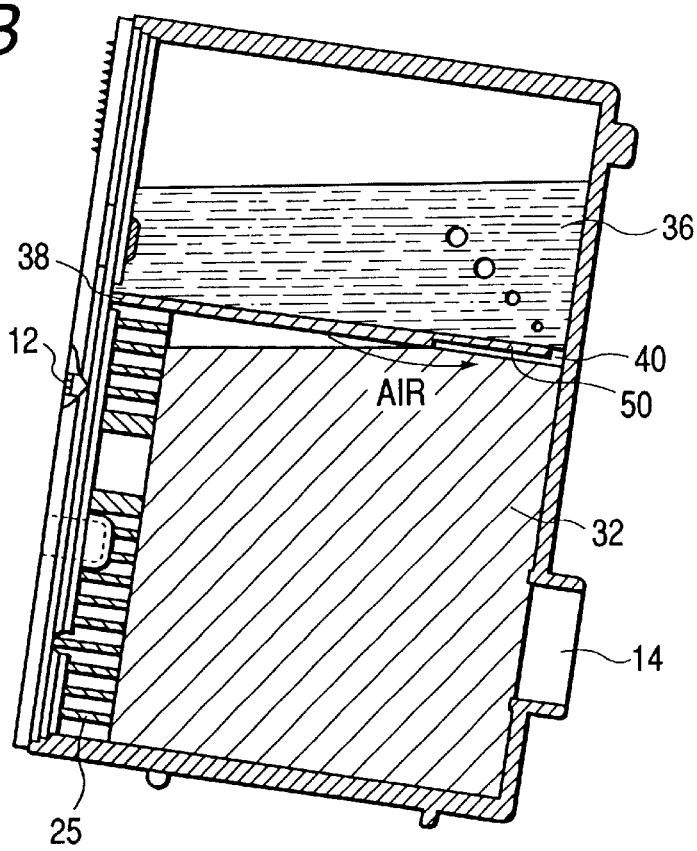

Particularly in the form provided with the liquid containing chamber as shown in FIGS. 1A and 1B, it is necessary to bring the negative pressure generating members into close contact with the inner wall of the container body so that the communicating portion 40 of the liquid containing chamber and the atmosphere may not directly communicate with each other.

When the negative pressure generating member is to be inserted into the liquid container of the present invention shown in FIGS. 2A and 2B, it is first necessary to bring the first negative pressure generating member 132B into close contact with the inner wall of the container body so that the communicating portion 140 of the liquid containing chamber and the atmosphere may not directly communicate with each other. In addition, when a plurality of negative pressure generating members are to be inserted into the container body, the close contact of the surfaces by which the negative pressure generating members contact with each other is required and it is also required that the surfaces (interface) be located at a side more separate from the bottom surface than the end portion of the atmosphere introducing path 150. However, if the plurality of negative pressure generating members are pressed in the direction of stack thereof while they are simply made to bear against each other, one of them may be crushed or irregularity may occur from product to product because both of them are deformable.

So, the inventors have zealously studied a method of manufacturing the container which will solve the above-noted problem with a result that it has occurred to mind to insert relatively softer one of the plurality of negative pressure generating members earlier into the container body, and compress it.

Figure 8:
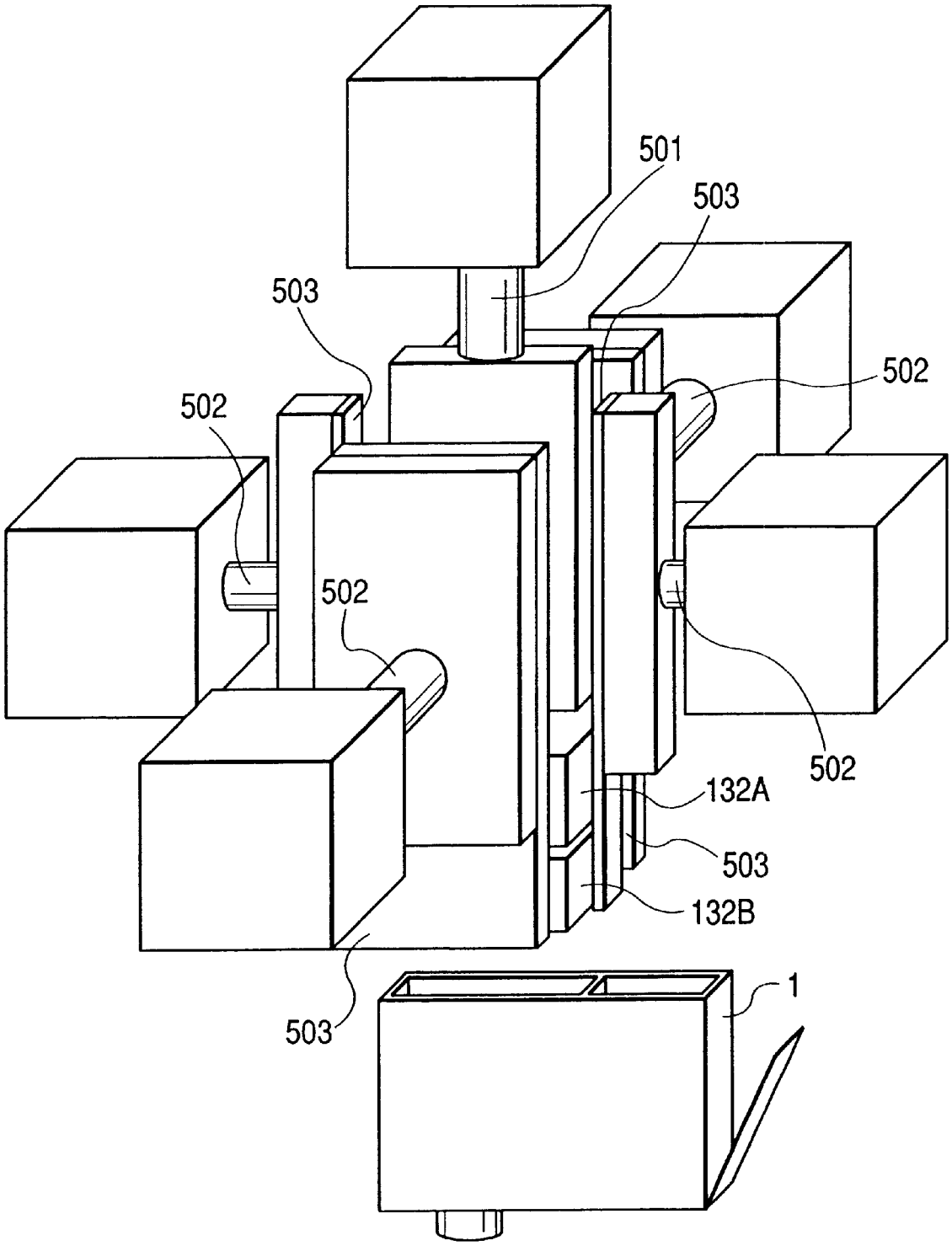
FIG. 8 is a typical view showing an example of an apparatus for manufacturing the liquid container of the present invention.

FIG. 8 is a typical view showing an example of a manufacturing apparatus which can realize a method of manufacturing the liquid container of the present invention which is based on the above-described novel findings of the inventors. In FIG. 8, the container body 1 of the liquid container has a recess for a negative pressure generating member containing chamber provided with a liquid supplying portion, and a recess for a liquid containing chamber, the recesses being formed integrally with a partition wall provided with a communicating portion, and is fixed by a fixing member, not shown, with the opening portion thereof facing upward. The reference numerals 501 and 502 designate cylinders slidable in the direction of extension of the cylindrical members thereof. The reference numeral 503 denotes a frame member (insertion pawl), and in the case of the present embodiment, four frame members contact with one another by the cylinder 502 to thereby form a hollow insertion tube. A first negative pressure generating member 132A and a second negative pressure generating member 132B can be contained in this insertion tube, and these are adapted to be pushed out of the insertion tube by the cylinder 501 as a push bar having an outer diameter substantially equal to the inner diameter of the insertion tube and slidable in the insertion tube.

Reference is now had to FIGS. 9A to 9F to describe the method of manufacturing the liquid container by the manufacturing apparatus shown in FIG. 8. FIGS. 9A to 9F are illustrations showing an example of the method of manufacturing the liquid container of the present invention.

Figure 9A:
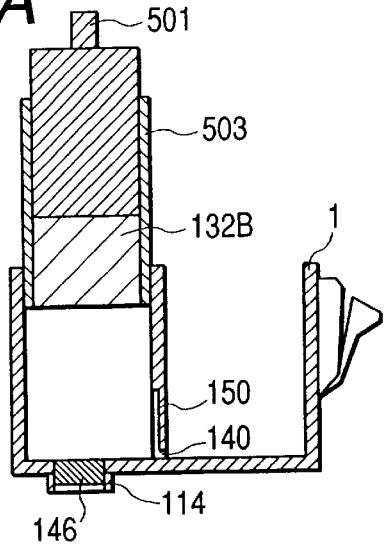
FIGS. 9A, 9B, 9C, 9D, 9E and 9F are illustrations showing an example of a method of manufacturing the liquid container of the present invention.

First, as shown in FIG. 9A, the container body 1 is prepared in which the recess for the negative pressure generating member containing chamber provided with an ink supply port 114 and the recess for the liquid containing chamber are formed integrally with the partition wall provided with a communicating portion 140 and an atmosphere introducing groove 150. The first negative pressure generating member larger than the inner dimension of the recess for the negative pressure generating member containing chamber has its four surfaces surrounded by the insertion pawl 503, and the cylinder 501 is applied to one of the surfaces thereof which are not surrounded, and the surface opposed to this surface is turned to the opening portion of the recess for the negative pressure generating member containing chamber of the container body. By the insertion pawl 503, the first negative pressure generating member 132B is crushed smaller than the opening portion of the negative pressure generating member containing chamber, and the insertion tube formed by the insertion pawl 503 is inserted into the opening portion of the negative pressure generating member containing chamber (the first inserting step). When as shown in FIGS. 2A and 2B, the urging member is provided in the ink supply port 114, it is desirable to insert the urging member in advance.

Figure 9B:
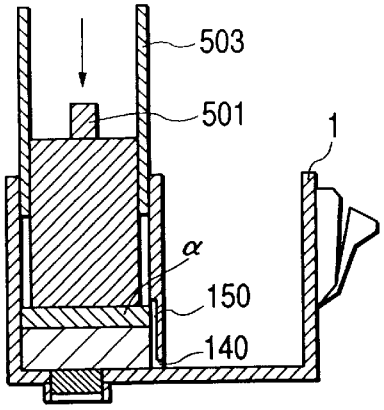

Next, as shown in FIG. 9B, the first negative pressure generating member 132B is pushed into the container by the cylinder 501. At this time, the location of the fore end of the insertion tube 503 is more toward the entrance side (the opening portion side) than the upper surface of the location into which the first negative pressure generating member is inserted, whereby there is the merit that when the insertion tube is pulled out, any force by the pulling-out is not created by the first negative pressure generating member 132B. Thereafter, the first negative pressure generating member 132B is pushed toward the bottom surface of the container (in the case of the present embodiment, that surface provided with the liquid supply port) by the cylinder 501, thereby making the first negative pressure generating member reach the bottom surface. Thereafter, the first negative pressure generating member is further compressed until the surface with which the second negative pressure generating member is in contact is somewhat crushed while the first negative pressure generating member is slidden relative to the inner side of the recess for the negative pressure generating member containing chamber (the first compressing step). The amount of crush of the first negative pressure generating member at this time is of the order of 0.2 to 1.5 mm when the height of the negative pressure generating member before inserted is 15 mm. By the first negative pressure generating member being thus compressed in advance in the container in the inserting direction, there is the merit that the first negative pressure generating member becomes easier to crush when the second negative pressure generating member is inserted.

Here, in the liquid container of the present embodiment, for the convenience of the molding of the container, the side forming the recess which provides the negative pressure generating member containing chamber is provided with such a gradient that a cross-sectional area parallel to the bottom surface decreases from the opening portion of the recess toward the bottom surface and therefore, by the above-described compressing step, the upper surface ($\alpha$ in FIG. 9B) of the first negative pressure generating member is preferentially deformed.

Figure 9C:
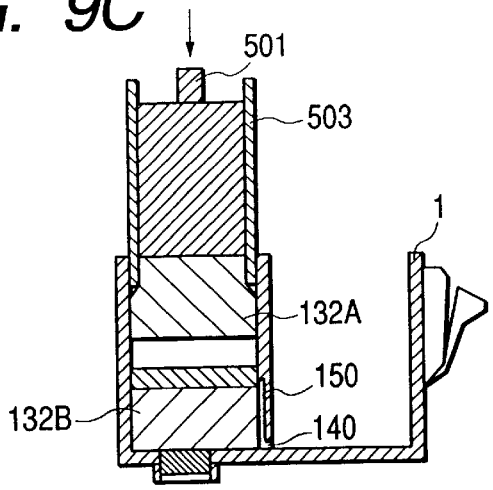
Figure 9D:
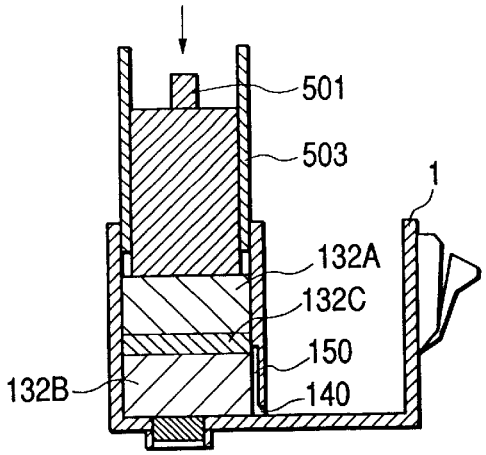

Next, as shown in FIG. 9C, like the aforedescribed first negative pressure generating member, the second negative pressure generating member is pushed from within the insertion tube 503 into the container by the cylinder 501. When the insertion is done, the second negative pressure generating member bears against the first negative pressure generating member, as shown in FIG. 9D. Thereafter, the second negative pressure generating member is further pushed by the cylinder, whereby the second negative pressure generating member is compressed in the inserting direction while being slidden relative to the inner side of the recess for the negative pressure generating member containing chamber (the second compressing step). Here, in order to ensure the close contact between the negative pressure generating members, in the manufacturing method shown in FIGS. 9A to 9F, it is desirable to set the amount by which the whole of the two negative pressure generating members is crushed by the cylinder to a value somewhat greater than the amount by which the first negative pressure generating member has been crushed by the cylinder.

Figure 9E:
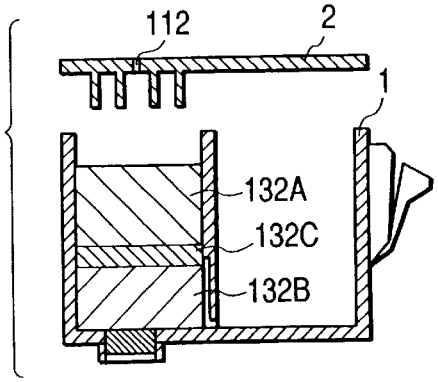
Figure 9F:
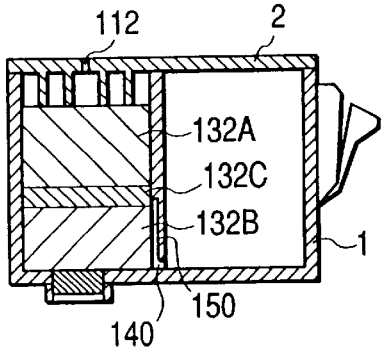

Thereafter, as shown in FIG. 9E, a lid member 2 provided with an atmosphere communicating opening 112 and covering both of the aforedescribed two recesses is prepared, and is fixed to the container body 1 as shown in FIG. 9F, to thereby form a negative pressure generating member containing chamber and a liquid containing chamber, whereby the container is completed. In the manufactured container, the interface 132C is located at a side more separate from the bottom surface than the end portion of the atmosphere introducing path 150, and by pouring liquid by a liquid pouring method which will be described later, the liquid container shown in FIGS. 2A and 2B can be provided.

Thus, in the above-described manufacturing method, the first negative pressure generating member which is not hard as compared with the second negative pressure generating member is compressed in advance in the container, whereby when the two capillary force generating members are urged against each other, the first negative pressure generating member can be deformed more preferentially to thereby suppress the close contacting property between the surfaces by which the two negative pressure generating members bear against each other, and the manufacturing irregularity of the position of the surfaces relative to the container body. As the result, the liquid container of the present invention can be manufactured inexpensively and easily.

While in the above-described example, the negative pressure generating members are inserted into the container body twice, the method of manufacturing the liquid container of the present invention is not restricted to the above-described form, but the two negative pressure generating members may be inserted at a time. So, an example of the manufacturing method when the two negative pressure generating members are inserted at a time will hereinafter be described with reference to FIGS. 10 to 10F. FIGS. 10A to 10F are illustrations showing another example of the method of manufacturing the liquid container of the present invention.

Figure 10A:
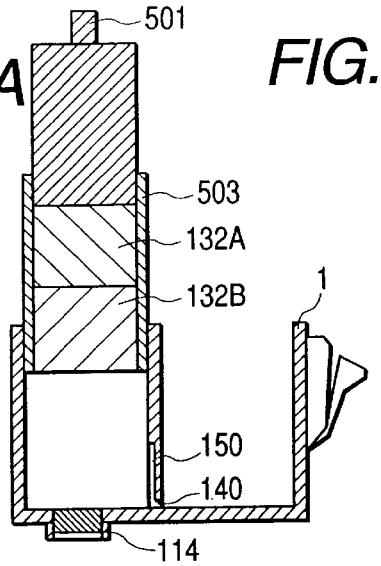
FIGS. 10A, 10B, 10C, 10D, 10E and 10F are illustrations showing another example of the method of manufacturing the liquid container of the present invention.

First, as shown in FIG. 10A, the first negative pressure generating member 132B and the second negative pressure generating member 132A are inserted into the insertion tube 503, and one end of the insertion tube is inserted into the opening portion opposed to the bottom surface of the container body 1. It is desirable that the position of the fore end of the insertion tube 503 at this time, as described with reference to FIGS. 9A to 9F, be more toward the opening portion side than the upper surface of the position into which the first negative pressure generating member 132B is inserted.

Figure 10B:
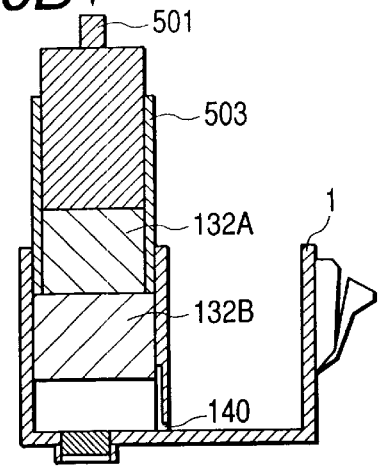

Next, as shown in FIG. 10B, the second negative pressure generating member is pressed toward the bottom surface of the container by the cylinder 501 to thereby push the first negative pressure generating member into the container (the first inserting step). Here, the first negative pressure generating member has no hindrance forwardly in the inserting direction thereof until it arrives at the bottom surface. In addition, with respect also to the side direction thereof, the first negative pressure generating member is moved from within the insertion tube of a narrow cross-sectional area into the container of a wider cross-sectional area and therefore, the compression in a direction intersecting with the inserting direction is liberated and therefore, even if the first negative pressure generating member is pressed by the cylinder through the second negative pressure generating member harder than the first negative pressure generating member, the force thereof can be reliably transmitted to the first negative pressure generating member. It is more desirable in order to effect the above-described insertion smoothly that the inner surface of the insertion tube be, for example, teflon-worked to thereby reduce the coefficient of friction between the inner surface of the insertion tube and the negative pressure generating members.

Figure 10C:
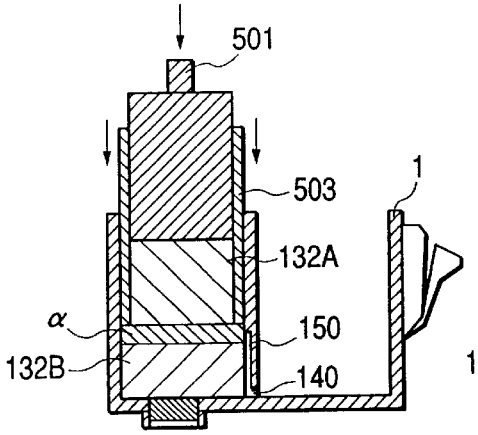

When as shown in FIG. 10B, the first negative pressure generating member is pushed out of the insertion tube into the container, the insertion tube and the cylinder are moved as a unit as shown in FIG. 10C and the first negative pressure generating member is further pressed toward the bottom surface. As the result, the first negative pressure generating member, with one surface thereof being in contact with the insertion tube and the second negative pressure generating member, has its opposed surface bearing against the bottom surface of the container body, and, the first negative pressure generating member is further compressed until its surface with which the second negative pressure generating member is in contact is somewhat crushed while sliding relative to the inner side of the recess for the negative pressure generating member containing chamber (the first compressing step).

Here, in addition to the original difference in hardness between the capillary force generating members, the second negative pressure generating member at this time has its sides in the inserting direction covered with the insertion tube and is compressed in a direction intersecting with the inserting direction, whereas the first negative pressure generating member has its side gradually moved toward the interior of the container having a wider cross-sectional area. Accordingly, to the pressing force in the inserting direction, the first negative pressure generating member becomes more preferentially easy to deform than the second negative pressure generating member. Again in the case of the present embodiment, the inner wall surface of the container is provided with a gradient, whereby that surface of the first negative pressure generating member which bears against the second negative pressure generating member can be preferentially deformed at the first compressing step.

Figure 10D:
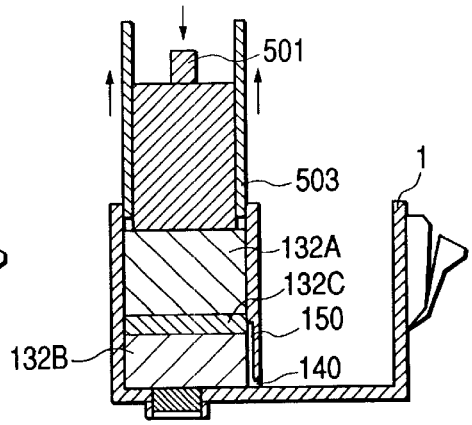

Thereafter, as shown in FIG. 10D, the insertion tube is pulled out while the position of the cylinder is held or a force is applied toward the bottom surface, and the second negative pressure generating member is compressed in the inserting direction while being further slidden relative to the inner side of the recess for the negative pressure generating member containing chamber by the cylinder (the second compressing step). Here, the second negative pressure generating member is hard and is held down by the cylinder, whereby even if the force by pulling out is created in the second negative pressure generating member 132A when the insertion tube is pulled out, it hardly happens that the interface 132C with the first negative pressure generating member moves.

Thereafter, as in FIGS. 9E and 9F, the lid member 2 is prepared (FIG. 10E) and the lid member 2 is mounted on the container body 1 to thereby complete the container.

FIGS. 11A to 11F are illustrations for illustrating a modification of the manufacturing method shown in FIGS. 10A to 10F, and correspond to FIGS. 10A to 10F. The differences of this modification from the embodiment shown in FIGS. 10A to 10F will hereinafter be described chiefly.

In the modification shown in FIGS. 11A to 11F, as compared with the form shown in FIGS. 10A to 10F, the inserted position of the end portion of the insertion tube into the container is nearer to the bottom surface side.

Figure 11A:
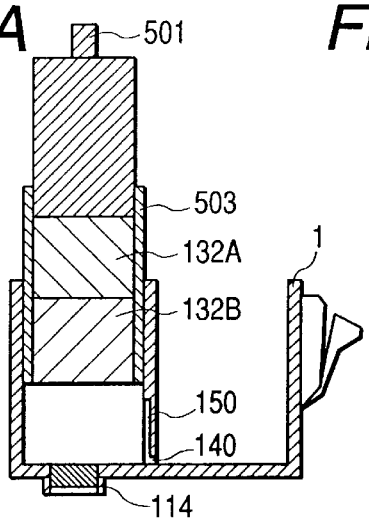
FIGS. 11A, 11B, 11C, 11D, 11E and 11F are illustrations showing still another example of the method of manufacturing the liquid container of the present invention.
Figure 11B:
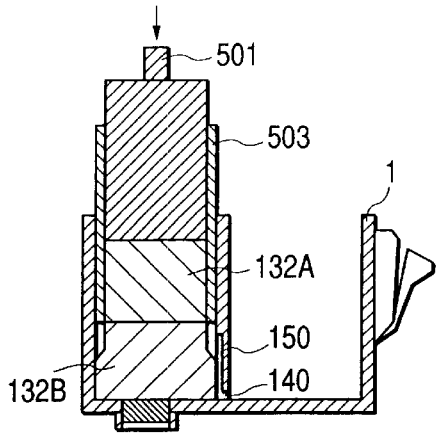

Therefore, before as shown in FIG. 11B, the first negative pressure generating member is completely pushed out of the insertion tube into the container, the first negative pressure generating member contacts with the bottom surface of the container.

Thus, in this modification, the first compressing step is executed before as shown in FIG. 1C, the first negative pressure generating member is completely pushed out of the insertion tube into the container, and it does not happen that as shown in FIG. 10C, the cylinder and the insertion tube press as a unit. That is, in the case of the present modification, the first compressing step is executed by only the cylinder through the second negative pressure generating member. Here, in addition to the original difference in hardness between the capillary force generating members, the second negative pressure generating member at this time has (almost all of) its sides in the inserting direction covered with the insertion tube and compressed in a direction intersecting with the inserting direction, whereas the first negative pressure generating member has its side gradually moved toward the interior of the container having a wider cross-sectional area. Accordingly, in the present modification, to the pressing force of the cylinder in the inserting direction at the first compressing step, the first negative pressure generating member is more preferentially easy to deform than the second negative pressure generating member.

Figure 10E:
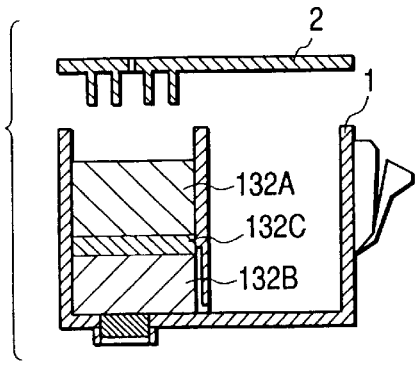
Figure 10F:
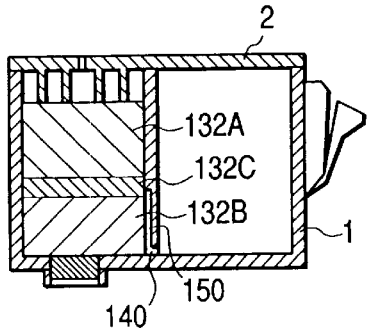
Figure 11C:
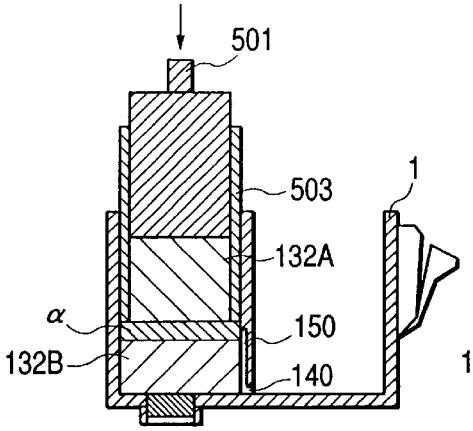
Figure 11D:
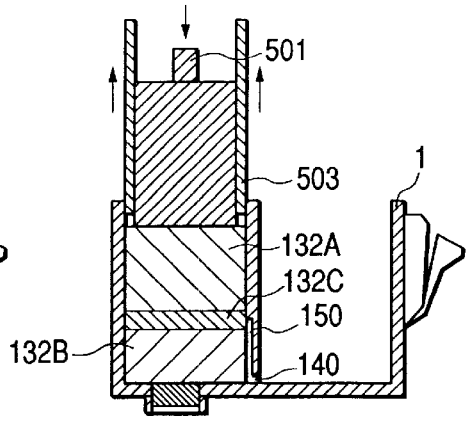
Figure 11E:
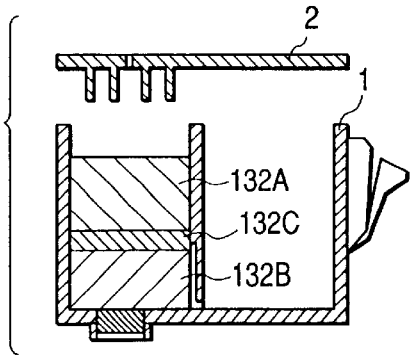
Figure 11F:
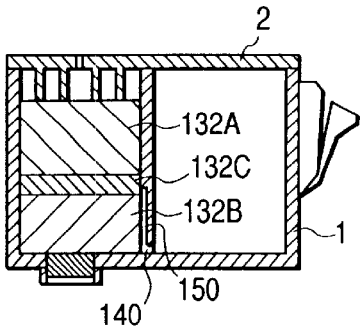

The present modification differs in up to the above-described first compressing step from the manufacturing method shown in FIGS. 10A to 10F, but thereafter, as shown in FIGS. 11D to 11F, the manufacture of the container is effected by the same steps as FIGS. 10D to 10F. In the present modification, as compared with the manufacturing method shown in FIGS. 10A to 10F, it is unnecessary to move the insertion tube and therefore, the manufacturing apparatus as shown in FIG. 8 can be made simpler.

Figure 12A:
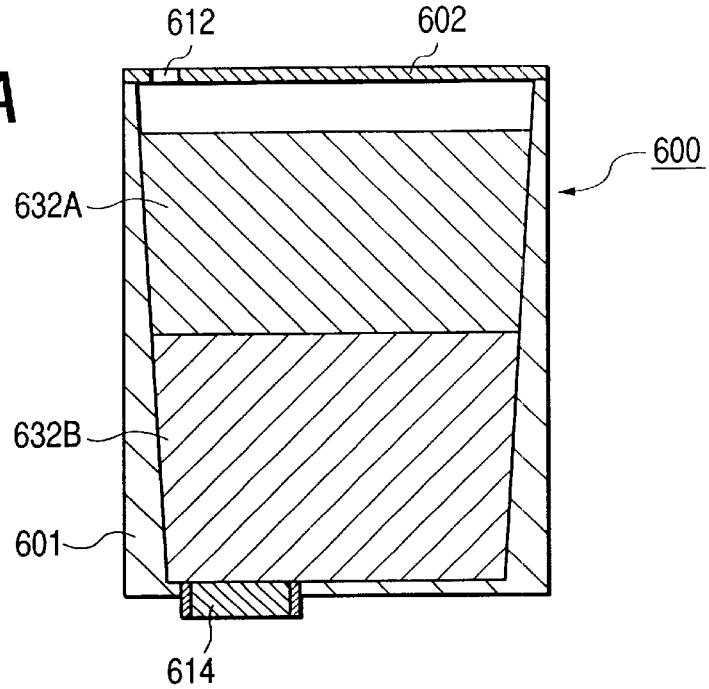
FIGS. 12A, 12B, and 12C are illustrations of a container manufactured by the use of the method of manufacturing the liquid container of the present invention, FIG. 12A being a cross-sectional view, and FIGS. 12B and 12C being illustrations showing an example of fiber as a negative pressure generating member used in the container shown in FIG. 12A.

The above-described method of manufacturing a liquid container is suitable for a liquid container provided with the liquid containing chamber of the present invention, but of course is not restricted thereto. That is, it can also be applied to a method of manufacturing a liquid container 600 provided with a plurality of negative pressure generating members 632A and 632B as shown in FIG. 12A. FIG. 12A is a cross-sectional view showing an example of a container to which the method of manufacturing the liquid container of the present invention is applicable, and the negative pressure generating member 632A is relatively harder than the negative pressure generating member 632B, and the bottom surface of the container body 601 is provided at the negative pressure generating member 632B side of the interface between the two negative pressure generating members, and a lid member is provided at the negative pressure generating member 632A side. The gradient of the side of the container described in connection with the aforedescribed manufacturing method is typically shown in FIG. 12A.

In FIG. 12A, there is shown an example in which the bottom surface of the container body 601 is formed with an ink supply port 614 and the lid member is formed with an atmosphere communicating port 612, whereas the locations of these are not restricted to the form shown in FIG. 12A, but may be reversed depending on the magnitude of the capillary forces generated by the capillary force generating members. However, if as in the example of the liquid container provided with the liquid containing chamber shown in FIG. 2A, etc. the relatively hard negative pressure generating member is weaker in capillary force, the respective negative pressure generating members can be made to generate desired capillary forces during the manufacturing process of the container and therefore, the irregularity of the magnitude of the capillary force by the product can be made smaller, and this is desirable.

Figure 12B:
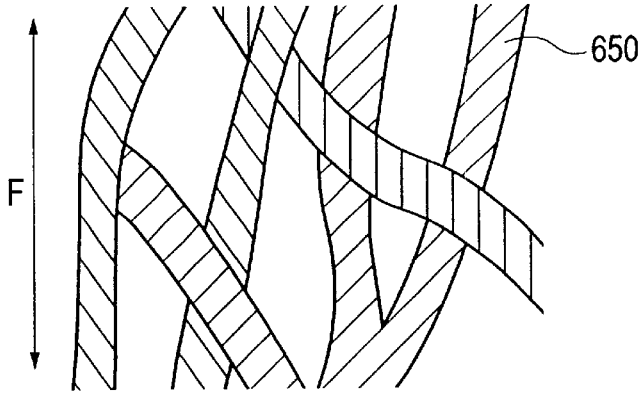
Figure 12C:
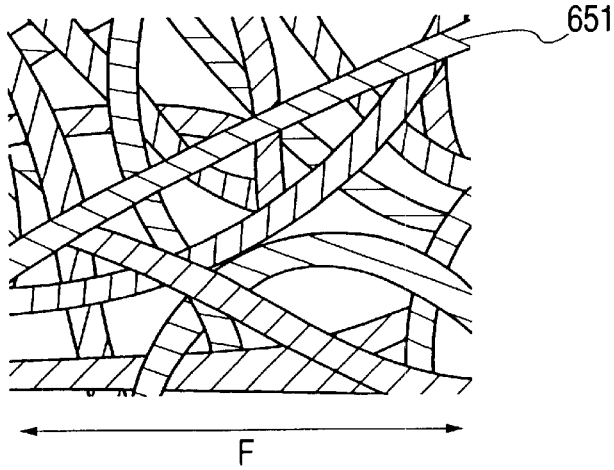
Figure 13:
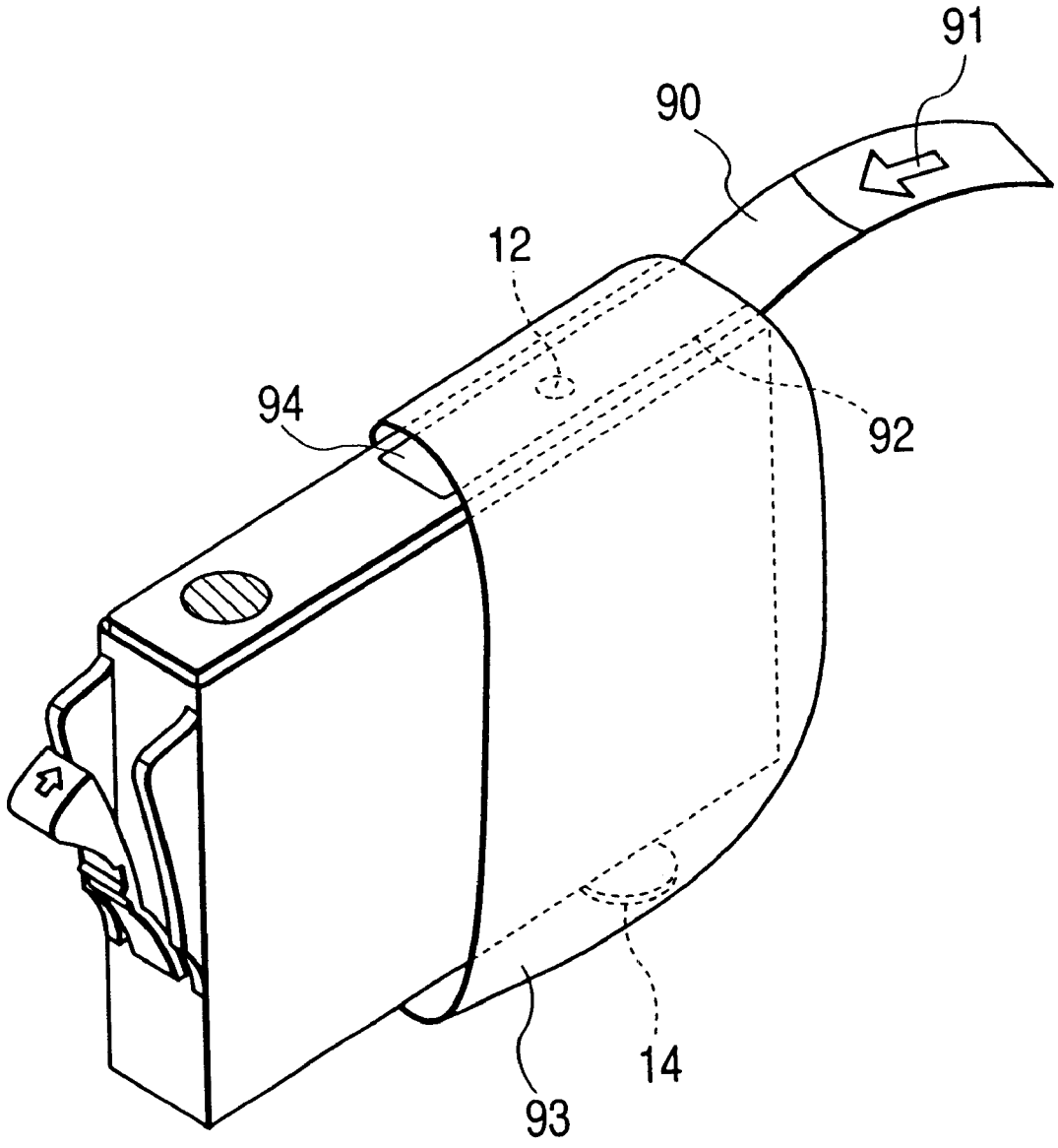
FIG. 13 is an illustration showing an example of a liquid container package according to an embodiment of the present invention.
Figure 14A:
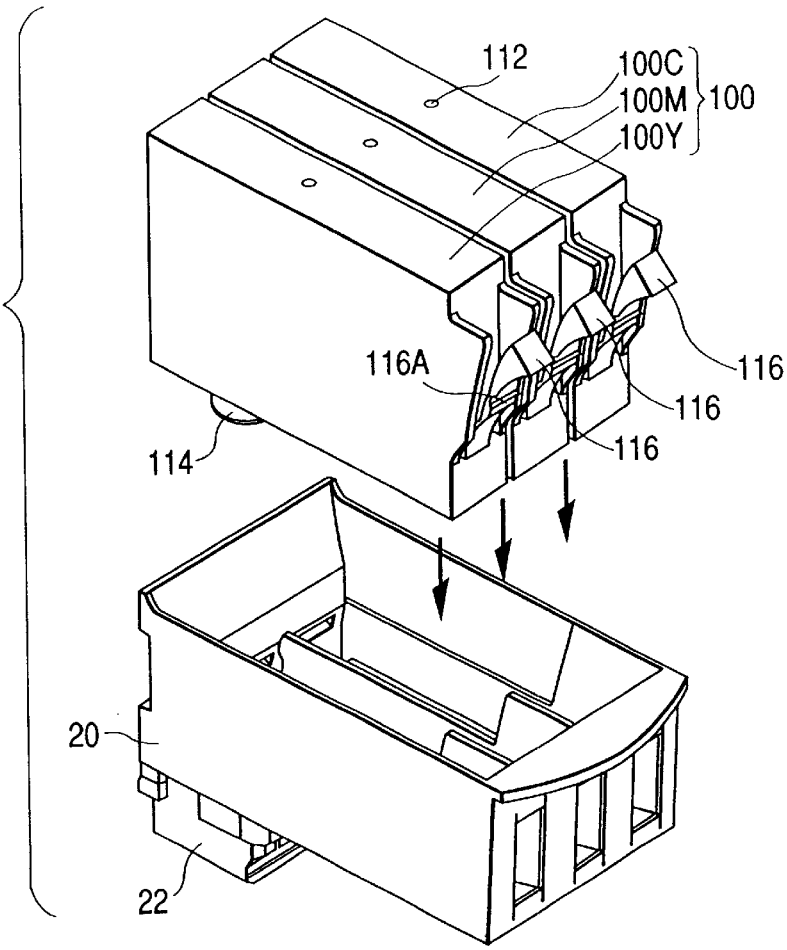
FIGS. 14A and 14B are schematic perspective views showing a liquid container and an integral head type holder according to an embodiment of the present invention, FIG. 14A showing the state before mounting, and FIG. 14B showing the state after mounting.
Figure 14B:
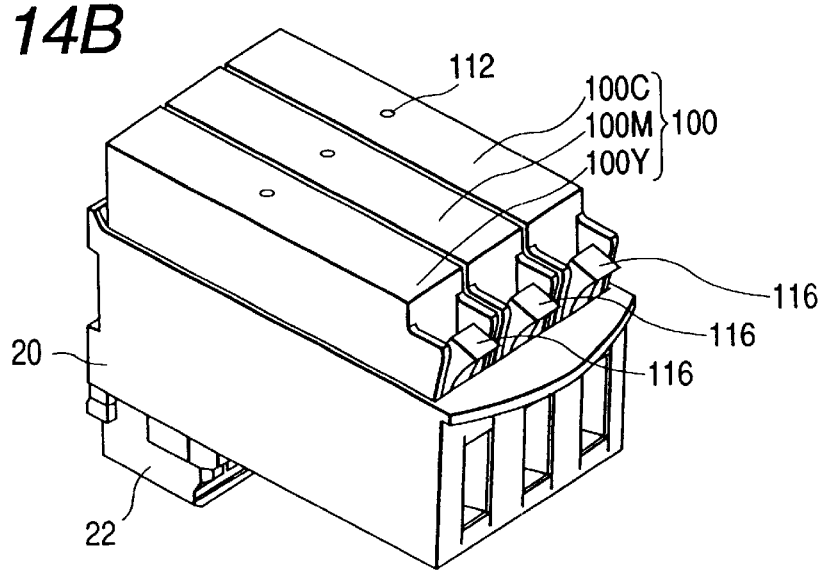
Figure 15:
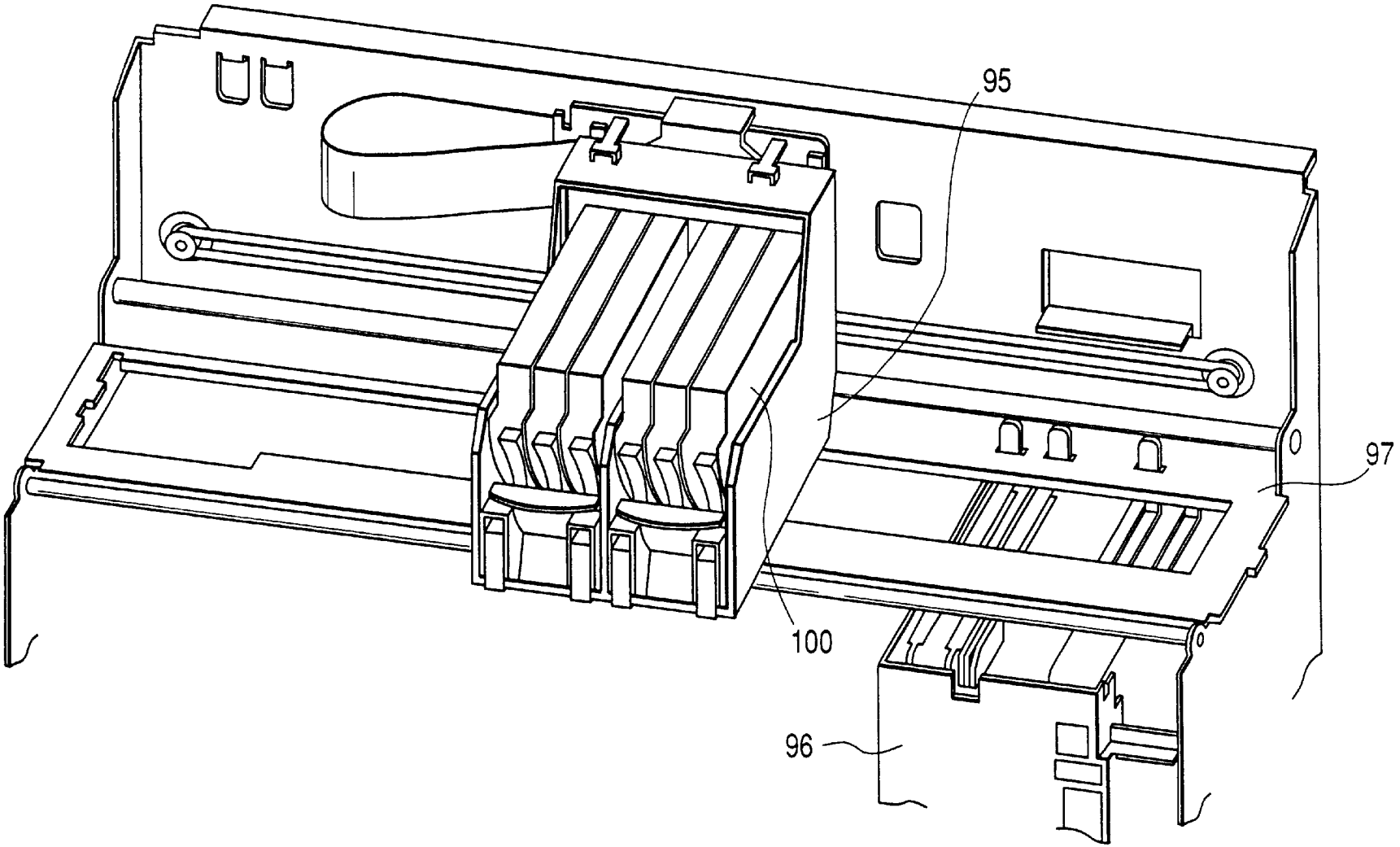
FIG. 15 is an illustration showing an example of a recording apparatus on which the liquid container of the present invention can be carried.

Also, when the above-described negative pressure generating members 632A and 632B are formed of a fiber material such as thermoplastic resin fiber, the fiber generally has a certain degree of directionality as disclosed, for example, in Japanese Patent Application Laid-Open No. 9-183236. So, as shown in FIG. 12B, the direction F in which the fibers 650 of the negative pressure generating member 632A are uniform becomes a direction toward the bottom surface of the container body 601 (the compressing direction during insertion), and as shown in FIG. 12C, the direction F in which the fibers 651 of the negative pressure generating member 632B are uniform becomes a direction parallel to the bottom surface of the container body 601 (a direction intersecting with the compressing direction during insertion), whereby the difference in hardness between the two negative pressure generating members with respect to the inserting direction thereof into the container can be made greater.

<Liquid Pouring and Package>

As the form of the liquid container of the present invention during distribution, the liquid pouring into the container and package will now be described with reference to FIG. 8.

A method of pouring liquid will first be described. Taking the case of the first embodiment as an example, a container containing no liquid therein is prepared, and the liquid containing chamber thereof is filled with liquid and the negative pressure generating member containing chamber thereof is filled with an amount of liquid which can be constantly held by the entire boundary layer between the negative pressure generating members irrespective of the posture of the liquid container. The liquid container into which a predetermined amount of liquid has been poured in such a manner becomes such that the boundary layer can function as gas introduction blocking means. A conventional method can be utilized as the method of pouring liquid into the respective chambers.

The present invention can effectively prevent the movement of air into the liquid containing chamber during distribution by pouring a predetermined or greater amount of liquid as described above, but the inventors have come to find out a more desirable condition about the amount of liquid to be poured, as the result of their further studies. This desirable condition will be described hereinafter.

The liquid container after the liquid has been poured thereinto by the above-described liquid pouring step, as will generally be described later, has its atmosphere communicating port and ink supply port hermetically sealed by seal members or the like, whereafter it is shipped so as to reach a user. In the liquid container after such distribution and before the seal members are opened, the first negative pressure generating member is filled with liquid nearly 100%, but the second negative pressure generating member is sometimes filled with a mixture of air and liquid.

If the seal of the liquid container is opened with air and liquid being thus mixed together in the second negative pressure generating member, when the pressure in the liquid container before its seal is opened is higher than the atmospheric pressure of the environment in which the seal is opened (that is, when the seal is opened under a reduced pressure environment), the air in the liquid container expands during the opening of the seal. At this time, if the air in the second negative pressure generating member is an air bubble surrounded by the liquid and isolated relative to the atmosphere, it may push up the liquid in the second negative pressure generating member to a buffer portion and in the worst case, the liquid may overflow from the atmosphere communicating port or the ink supply port.

So, when the inventors have zealously studied about this phenomenon, they have found that the amount of liquid filling the second negative pressure generating member in the negative pressure generating member containing chamber is concerned in it.

So, when in the liquid container shown in FIGS. 2A and 2B, the volume of the liquid containing chamber was 6.7 cc and the volume of the first negative pressure generating member was 4.2 cc and the volume of the second negative pressure generating member was 5.4 cc and the surface forming the buffer chamber of the second negative pressure generating member was 8×40 mm and liquid was poured under the condition of 1.0 atmospheric pressure, and thereafter the ink supply port and the atmosphere communicating port were sealed and the relation between the amount of liquid filling the second negative pressure generating member in the negative pressure generating member containing chamber and the leakage of the liquid when the seal was opened under 0.7 atmospheric pressure after distribution was examined, there was obtained a result as shown in Table 1 below.

TABLE 1

| sample | rate of filling the 2nd negative pressure generating member with liquid | leakage of liquid when the seal was opened |
|---|---|---|
| A | 63% | none |
| B | 67% | none |
| C | 69% | none |
| D | 73% | leakage occurred |
| E | 77% | leakage occurred |
| F | 85% | leakage occurred |
| G | 89% | leakage occurred |

As is apparent from this table, in the above-described form, the rate of filling the second negative pressure generating member with ink is made less than 70%, whereby the leakage of the liquid out of the liquid container can be reliably prevented even if the pressure in the liquid container before opened and the atmospheric pressure when the container is opened differ remarkably from each other.

The upper limit of this rate of filling the second negative pressure generating member with liquid is varied chiefly by the relation between the volume of the second capillary force generating member and the surface forming the buffer chamber of the second negative pressure generating member, and if for example, the volume of the second negative pressure generating member is the same, but the surface forming the buffer chamber is relatively large, the liquid will not leak during the opening of the container even if the rate of filling the second negative pressure generating member with liquid is made somewhat greater than the above-mentioned value. Accordingly, optimum rates can be determined in conformity with respective cases, but generally when the liquid container is used as a liquid container in the field of ink jet recording, the value of this upper limit is about 60% to 85%.

Description will now be made of the package which is the form during distribution. To sell a container into which a predetermined amount of liquid has been poured by the above-described method of manufacturing a liquid container (the liquid pouring method), it is desirable to seal the atmosphere communicating port and the ink supply port during distribution. So, these are sealed by the utilization of the package. The package of the present invention has seal means for sealing the liquid supply port 14 and atmosphere communicating portion 12 of the container into which the liquid has been poured.

In an example of the package shown in FIG. 8, the sealing of the atmosphere communicating portion is effected by an atmosphere communicating portion sealing member 94 and the sealing of the ink supply port is effected by a cap, not shown. The sealing may be done by a cover member which will be described later, instead of the cap.

In this example, a portion of the atmosphere communicating portion sealing member 94 is intactly extended beyond the end surface of the ink tank and provides a knob portion 90. A portion of the knob portion is formed with a display portion 91 for clearly displaying that it is the knob portion. Around the atmosphere communicating portion sealing member and the cap, there is disposed a cylindrical cover member 93 covering these.

In such a package, not only the atmosphere communicating portion and the liquid supply port are sealed, but also provision is made of gas introduction blocking means cooperating with the partition wall and the liquid contained in the negative pressure generating member containing chamber to block the introduction of gas from the communicating portion into the liquid containing chamber except during the supply of the liquid from the liquid supplying portion to the outside, whereby the liquid can be prevented from leaking to the outside irrespective of the posture of the container.

In the case of the above-described package, the user first sees the knob portion 90 on which the display portion 91 is formed and therefore, grasps this knob portion so as to start the work of opening the package. Thereupon, the cover member is stripped off by the end portion 92 of the atmosphere communicating portion sealing member and the atmosphere communicating port is opened, whereafter the cap becomes removable. By thus prescribing the order of opening of the seal, the leakage of the liquid out of the liquid supply port during the opening of the seal can be better prevented with the above-described gas introduction blocking means.

<Ink Jet Head Cartridge>

An ink jet head cartridge to which the liquid container of the present invention is applicable will now be described with reference to FIGS. 9A to 9F.

In FIGS. 9A to 9F, the reference numeral 116 designates a lever member elastically deformably and integrally formed outside the liquid container (ink tank) 100, and a restraining projection is formed on the intermediate portion thereof.

The reference numeral 20 denotes a head cartridge on which the above-described ink tank 100 is mounted, and in the present embodiment, it contains therein ink tanks 100 (100C, 100M and 100Y) of e.g. cyan C, magenta M and yellow Y. A color ink jet head 22 is integrally provided in the lower portion of the head cartridge 20. The color ink jet head 22 formed with a plurality of downwardly facing discharge ports. These recording heads use a system provided with means (e.g. electro-thermal converting members or the like) generating heat energy as energy utilized to effect ink discharge, among ink jet recording systems, and causing a state change in the ink by the heat energy, thereby realizing higher density and higher minuteness of recording.

The ink tank 100 is then pushed from its state shown in FIG. 9A into the head cartridge 20 so that the ink supplying cylinder 114 thereof may be engaged with the ink supplying cylinder receiving portion, not shown, of the color ink jet head 22 and the ink path cylinder of the color ink jet head 22 may move into the ink supplying cylinder 114. Thereupon, the restraining projection 116A of the lever member 116 comes into engagement with a projection, not shown, formed at a predetermined location on the head cartridge 20, and a regular mounted state shown in FIG. 1B is obtained. The head cartridge 20 with the ink tank 100 mounted thereon is further carried on the carriage of an ink jet recording apparatus which will be described later, and is rendered capable of printing.

While in the foregoing description, the liquid container is separable from the head cartridge, it may of course be made integral with the latter.

<Liquid Discharge Recording Apparatus>

Lastly, an example of a liquid discharge recording apparatus capable of carrying the above described liquid container or ink jet head cartridge thereon will be described with reference to FIGS. 10A to 10F.

In the recording apparatus shown in FIGS. 10A. to 10F, the reference numeral 95 designates a carriage capable of removably carrying the liquid container 100 (or the above-described ink jet head cartridge) thereon, the reference numeral 96 denotes a head recovering unit in which a head cap for preventing the drying of the ink from the plurality of orifices of the head and a suction pump for sucking the ink from the plurality of orifices during the bad operation of the head are incorporated, and the reference numeral 97 designates a paper supply surface to which recording paper as a recording medium is conveyed.

The carriage 95 has its position on the recovering unit 96 as a home position, and printing is started by the carriage beginning to scan in the leftward direction as viewed in FIGS. 10A to 10F.

As described above, according to the first invention-of this application, the liquid is always contained in the negative pressure generating member near the communicating portion, and the introduction of gas from the communicating portion into the liquid containing chamber except during the supply of the liquid from the liquid supplying portion to the outside can be blocked and therefore, there can be provided an ink tank which can effect the stable supply of ink even if it is subjected to distribution in the state before the use is started.

Also, according to the second invention of this application, the above-described ink tank can be provided on the basis of the relation among the capillary forces, hardness and interface of the two negative pressure generating members when the two members are urged against each other.

What is claimed is:

1. A liquid container comprising:

a negative pressure generating member containing chamber containing therein first and second negative pressure generating members urged against each other to form an interface and provided with a liquid supplying portion and an atmosphere communicating portion, a liquid containing chamber provided with a communicating portion communicating with said negative pressure generating member containing chamber and forming a substantially hermetically sealed space and storing therein liquid to be supplied to said negative pressure generating members, and a partition wall for partitioning said negative pressure generating member containing chamber and said liquid containing chamber and forming said communicating portion, wherein the interface of the urged portions of said first and second negative pressure generating members intersects with said partition wall, said first negative pressure generating member communicates with said communicating portion and can communicate with said atmosphere communicating portion only through the interface of said urged portions, said second negative pressure generating member can communicate with said communicating portion only through the interface of said urged portions, a weaker capillary force negative pressure generating member of said first and second negative pressure generating members is weaker in capillary force than a stronger capillary force negative pressure generating member of said first and second negative pressure generating members and is harder than the stronger capillary force negative pressure generating member, and the negative pressure generating member containing chamber is filled with an amount of liquid which can be held by the entire interface of said urged portions irrespective of the posture of the liquid container.

2. A liquid container according to claim 1, characterized in that both of said first and second negative pressure generating members are formed of a fiber material, and the average diameter of the cross-section of the fiber forming said weaker capillary force negative pressure generating member is greater than the average diameter of the cross-section of the fiber forming the stronger capillary force negative pressure generating member.

3. A liquid container according to claim 1, characterized in that both of said first and second negative pressure generating members are formed of a plurality of kinds of thermoplastic fiber materials, and a percentage of a fiber material of a low melting point in the fiber materials forming the weaker capillary force negative pressure generating member is higher than a percentage of a fiber material of a low melting point in the fiber materials forming the stronger capillary force negative pressure generating member.

4. A liquid container according to claim 2, characterized in that both of said first and second negative pressure generating members are formed of a plurality of kinds of thermoplastic fiber materials, and a percentage of a fiber material of a low melting point in the fiber materials forming the weaker negative pressure generating member is higher than a rate of a fiber material of a low melting point in the fiber materials forming the stronger negative pressure generating member.

* * * * *

UNITED STATES PATENT AND TRADEMARK OFFICE

CERTIFICATE OF CORRECTION

PATENT NO. : 6,502,931 B2
DATED : January 7, 2003
INVENTOR(S) : Kenta Udagawa et al.

It is certified that error appears in the above-identified patent and that said Letters Patent is hereby corrected as shown below:

Column 7,
Line 5, “being-harder” should read -- being harder --.

Column 11,
Line 7, “P2<p1<Ps” should read -- P2<P1<Ps --; and
Line 46, “afore described” should read -- aforedescribed --.

Column 19,
Line 47, “FIG. 1C,” should read -- FIG. 11C, --.

Column 24,
Line 7, “invention-of” should read -- invention of --.

Signed and Sealed this

Twenty-first Day of October, 2003

JAMES E. ROGAN
*Director of the United States Patent and Trademark Office*